US006881014B2

(12) United States Patent
Saeki et al.

(10) Patent No.: US 6,881,014 B2
(45) Date of Patent: Apr. 19, 2005

(54) SCREWED STEEL PILE AND METHOD OF CONSTRUCTION MANAGEMENT THEREFOR

(75) Inventors: Eiichiro Saeki, Tokyo (JP); Hitoshi Ooki, Tokyo (JP); Tomoki Takeda, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/034,900

(22) Filed: Dec. 27, 2001

(65) Prior Publication Data

US 2002/0090271 A1 Jul. 11, 2002

Related U.S. Application Data

(62) Division of application No. 09/423,563, filed as application No. PCT/JP99/01165 on Mar. 10, 1999, now Pat. No. 6,394,704.

(30) Foreign Application Priority Data

| | | |
|---|---|---|
| Mar. 10, 1998 | (JP) | 10-76722 |
| Mar. 20, 1998 | (JP) | 10-92286 |
| Jul. 8, 1998 | (JP) | 10-192674 |
| Jul. 8, 1998 | (JP) | 10-192747 |
| Aug. 5, 1998 | (JP) | 10-221443 |
| Sep. 29, 1998 | (JP) | 10-275486 |
| Oct. 29, 1998 | (JP) | 10-309023 |
| Mar. 2, 1999 | (JP) | 11-54783 |

(51) Int. Cl.[7] ..... E02D 5/56

(52) U.S. Cl. ..... 405/236; 405/244; 405/252.1; 405/253; 405/233

(58) Field of Search ..... 405/252.1, 253, 405/249, 231, 229, 241, 242, 244, 257, 255; 52/157, 155; 175/394

(56) References Cited

U.S. PATENT DOCUMENTS 101,379 A 3/1870 Parker (Continued)

FOREIGN PATENT DOCUMENTS

| | | |
|---|---|---|
| EP | 0 588 143 | 3/1994 |
| GB | 769 846 | 3/1957 |

(Continued)

OTHER PUBLICATIONS

International Search Report for PCT/JP99/01165.

*Primary Examiner*—Frederick L. Lagman
(74) *Attorney, Agent, or Firm*—Kenyon & Kenyon

(57) ABSTRACT

There is provided a screwed steel pile, the end portion of which is open, characterized in that: an apparent resistance at the pile end portion of the pile is reduced when the ground strength is suddenly increased, so that the pile can be easily penetrated into the ground and an intensity of the finally obtained bearing capacity of the pile is high.

The specific means is that a pile end portion of the pile body composed of a steel pipe or a hollow pipe made of another material is made open, and one or a plurality of wings are provided on the outside of the pile end portion of the pile body. The pile end portion of the wing may be protruded downward from a pile end face of the pile body.

There is provided a method of construction management for managing the construction of a screwed steel pile having one or a plurality of wings on the outside face of the lower end portion of the pile, comprising the steps of: finding penetrative resistance Rp of a bottom plate portion in the process of construction from the balance between inputted energy, which has been inputted to the pile top portion, and consumed energy which has been released from the bottom plate portion; and controlling to continue and/or complete penetration of the screwed steel according to an intensity of penetrative resistance while the penetrative resistance Rp is being found.

10 Claims, 23 Drawing Sheets

U.S. PATENT DOCUMENTS

| | | | | |
|---|---|---|---|---|
| 4,790,689 | A | 12/1988 | Henn et al. | 405/240 |
| 4,793,740 | A | 12/1988 | Schellhorn | 405/232 |
| 5,188,485 | A | 2/1993 | Forster et al. | 405/232 |
| 6,394,704 | B1 * | 5/2002 | Saeki et al. | 405/252.1 |
| 6,425,713 | B1 * | 7/2002 | Fox et al. | 405/243 |

FOREIGN PATENT DOCUMENTS

| | | |
|---|---|---|
| JP | 49-39045 | 10/1974 |
| JP | 50-143307 | 11/1975 |
| JP | 56-34823 | 4/1981 |
| JP | 61-98818 | 5/1986 |
| JP | 62-25612 | 2/1987 |
| JP | 62-86224 | 4/1987 |
| JP | 63-61440 | 4/1988 |
| JP | 64-39415 | 2/1989 |
| JP | 1-94122 | 4/1989 |
| JP | 2-26634 | 2/1990 |
| JP | 2-26643 | 2/1990 |
| JP | 3-54825 | 5/1991 |
| JP | 3-194017 | 8/1991 |
| JP | 4-179728 | 6/1992 |
| JP | 5-163727 | 6/1993 |
| JP | 7-11637 | 1/1995 |
| JP | 7-011637 | 1/1995 |
| JP | 7-20388 | 4/1995 |
| JP | 7-331654 | 12/1995 |
| JP | 8-226124 | 9/1996 |
| JP | 9-324421 | 2/1997 |
| JP | 9-144459 | 6/1997 |
| JP | 9-324491 | 12/1997 |
| NL | 84 615 | 3/1957 |

* cited by examiner (a)

(b)

(a)

(b)

(a)

(b)

(c)

(a)

(b)

SCREWED STEEL PILE AND METHOD OF CONSTRUCTION MANAGEMENT THEREFOR

This application is a divisional application under 37 C.F.R. §1.53(b) of prior appllicaton Ser. No. 09/423,563 filed Nov. 10, 1999 now U.S. Pat. No. 6,394,704 which is a 35 U.S.C. §371 National Stage of International Application No. PCT/JP99/01165 filed Mar. 10, 1999. International Application No. PCT/JP99/01165 was filed and published in the Japanese language. The disclosures of the specification, claims, drawings and abstract of application Ser. No. 09/423,563 filed Nov. 10, 1999 and of International Application No. PCT/JP99/01165 filed Mar. 10, 1999 are incorporated herein by reference.

FIELD OF THE INVENTION

The present invention relates to steel piles used for foundation of buildings and others. More particularly, the present invention relates to screwed steel piles having blades for digging and also relates to a method of construction management therefor.

DESCRIPTION OF THE PRIOR ART

In the pile driving method or the pile displacing method, which is a conventional construction method for foundation piles used for construction of buildings and others, problems may be caused by noise and vibration generated in the process of construction. In order to solve the above problems, screwed steel piles have already been proposed. For example, Japanese Examined Patent Publication No. 2-62648 discloses a screwed pile characterized in that: an opening of a forward end portion of a pile body is closed by a bottom plate; a excavation blade is provided on the bottom plate so as to reduce a penetrative resistance of the pile; and a spiral wing is provided on an outer face of a lower end portion of the pile body. This screwed pile is buried in the soil in such a manner that soil and sand located at the forward end of the pile body is weakened by the excavation blade provided at the forward end of the pile body, and the pile is screwed into soil and sand, which has not been drilled yet, so that the wing can drill into the soil and sand.

However, the following problems may be encountered in the above screwed steel pile. The wing is arranged at an upper position of the bottom plate on the side of the pile body, and further the excavation blade and the wing are uncontinuously arranged with each other. Therefore, it is difficult for soil and sand, which is located at a position lower than the bottom plate, to be moved upward in the process of construction. Accordingly, it becomes difficult to generate a sufficiently high intensity of thrust. Especially when the soil at the bottom plate portion is hard and the soil close to the wing is soft, it very difficult for soil and sand to be moved to an upper portion of the wing.

In order to enhance the excavation effect, it is effective to provide a large size of blade on the bottom plate. However, the following problems may be encountered according to this structure. Although the efficiency of excavation can be enhanced, even if drilling of the pile is finished, the ground at the forward end of the pile is softened. Therefore, it is impossible to obtain an effectively high intensity of bearing capacity.

In order to solve the above problems, the following method is proposed. For example, according to Japanese Unexamined Patent Publication No. 8-226124, in the case of a steel pipe pile having a screw wing at the forward end, there are provided opening ribs for blocking soil and sand during penetrating the steel pipe pile, which are arranged inside the steel pipe pile at an upper position of the forward end of the steel pipe. That is, no conventional bottom plate is arranged at the lower end of the steel pipe pile. Accordingly, a penetrative resistance is low, and it is possible to penetrate the steel pipe pile by torque of low intensity. However, even if the above steel pipe pile is used, it is impossible to enhance the construction accuracy of the steel pipe pile. The reason why it is impossible to enhance the construction accuracy the steel pipe pile is that configurations of the spiral wing and the forward end portion of the steel pipe are not appropriate. Further, Japanese Unexamined Patent Publication No. 8-291518 discloses a steel pipe pile in which a plurality of rows of spiral wings are provided at a forward end of the outer circumferential portion of the steel pipe pile, and the interval, length and height of the spiral wing are specified, and further an incomplete wing is arranged at the lower end of the steel pipe pile. In this steel pipe pile, since this incomplete wing is attached to the side of the steel pipe, a projected area of the wing exceeds 360°, and the construction efficiency is deteriorated.

Japanese Unexamined Patent Publication No. 8-326053 discloses a steel pipe pile in which a forward end portion of the pipe pile body is spirally cut out along the outer circumference, and a spiral bottom plate, which is used as an excavation cutter, the diameter of which is approximately twice as large as that of the pile body, is fixed to a forward end face which has been cut out.

When this steel pipe pile is used, it is possible for the spiral bottom plate, which is also used as an excavation blade, to facilitate drilling and softening soil and sand at the forward end portion of the pile body, and even in the case of a pile body, the diameter of which is large, it can be easily rotated and advanced into the ground. However, essentially, the above steel pipe pile is a pile, the forward end portion of which is closed by the bottom plate. Therefore, in the process of construction, this steel pipe pile is given a high intensity of reaction force by the ground located in a portion close to the bottom plate.

For the purpose of reducing the penetrative resistance given to the forward end of the pipe so that the drilling torque can be reduced in the process of construction, the present inventors have already proposed a pile, the forward end of which is open, in Japanese Patent Application No. 9-314461. The present invention is accomplished as a variation of the above patent application. According to the present invention, the excavation efficiency can be remarkably enhanced, that is, the drilling torque can be remarkably reduced and the penetration efficiency of can be remarkably enhanced.

As shown in FIG. 23, according to the method of construction of this screwed steel pile, the screwed pile 1 includes a spiral wing 2, which will be referred to as a wing hereinafter in this specification, arranged at a lower end portion of the pile 1, wherein soil and sand is pushed in the direction of the side of the pile by the wing so that the pile can be given thrust.

In this connection, usually, a large number of piles are excavated into the ground. Therefore, in order to shorten the work period of pilling, it is important to enhance the efficiency of excavation of one pile.

According to the prior art described before, in the case where the strength of the ground 100 changes suddenly, the resistance given to the bottom plate 4 arranged at the lower end of the pile 1 exceeds a force of thrust generated by the wing. In this case, an amount of penetration of the pile is approximately not more than 5 mm. Therefore, a gap is formed under the lower face of the wing. When the above state continues, the wing is idly rotated, that is, it becomes impossible for the pile to generate a force of thrust. The aforementioned prior art has the above disadvantages.

In order to solve the above problem of the prior art in which it becomes impossible for the pile to generate a force of thrust, force F is given to the pile top as shown in FIG. 23 so that the ground close to the bottom plate can be scraped off a little. In this way, the pile is rotated until a predetermined intensity of thrust can be obtained. When a capacity of a pile driver used for burying the pile is insufficient, it becomes necessary to replace the pile driver with another pile driver having a large capacity.

As described above, when the prior art is used for constructing the piles, it takes a long time, which causes a large loss.

A configuration of the excavation blade attached to the bottom plate portion has been improved, and also a configuration of the forward end portion of the wing has been improved. However, these configurations are determined according to the nature of the ground to be excavated so that the ground can be excavated effectively. Therefore, when the nature of the ground is changed, the excavated efficiency is greatly deteriorated. That is, it is difficult to replace the wing and the pile with the most appropriate ones according to the nature of the ground 100.

In this connection, in order to build buildings and others stably on the ground, it is necessary that a bearing capacity, the intensity of which is the same as that of the designed value, is provided by the foundation pile. Since the circumstances of the pile and the ground cannot be measured and checked by a builder who is on the ground, it is desirable that the bearing capacity of the pile is estimated by the construction record.

However, except for the driven pile, the bearing capacity of which can be estimated by an penetrative resistance obtained in the process of construction, the bearing capacity cannot be estimated by the construction record. In the case of a bored pile or a cast-in-place-pile, it is impossible to estimate the bearing capacity of the pile by the circumstances of construction.

In the conventional screwed pile, drilling torque is used for the confirmation of the bearing stratum of the ground in the construction management. It is commonly said that drilling torque is appropriate to grasp the circumstances of the ground. However, drilling torque fluctuates greatly. Therefore, when the construction management is conducted only according to the drilling torque, there is a great risk of misjudging the circumstances of the ground.

Conventionally, the following specific construction methods are provided. The prior art is described as follows. In one method, the screwed pile in which a pile, the end of which is open, is screwed and given a load at the same time, so that the pile can penetrate into the ground. In the other method the inside-drilling method in which an auger rod is rotated inside a pipe pile to be displaced into the ground, so that the ground can be excavated and the pipe pile can intrude into the ground.

In the case of the method described in the above prior art, only rotation and load are given to the pile. Therefore, it is possible to conduct the excavation of a pile in the soft ground. However, according to the above screwed pile method, soil and sand rises in the pipe pile. Accordingly, soil and sand blocks the pipe pile when it rises to a certain position in the pipe pile. As a result, a penetrative resistance is increased and the excavation rate is decreased. When the pile penetrates a hard intermediate bearing stratum or the pile is put into a hard bearing stratum and when a diameter of the pipe pile is large, the motor capacity is not sufficient, so that the pile cannot penetrate the ground. Therefore, the excavation efficiency is lowered. In order to solve the above problems, it is necessary to increase the capacity of the construction machine.

In the inside-drilling method, the auger rod is rotated and the pile is displaced into the ground. According to the above method, waste soil and sand is raised by the auger rod, and a soft ground around the pile can seldom be tightened. Therefore, it is difficult to obtain a sufficiently high bearing capacity of the pile. According to this method, it is necessary to excavate the ground in the pipe pile at all times. Therefore, unless a circumferential face fixing solution is used, the circumferential face friction is reduced.

SUMMARY OF THE INVENTION

A first object of the present invention aims at a closed end screwed steel pile, the forward end of the pile body of which is open, or a closed end screwed steel pile, the entire forward end of the pile body of which is closed by a bottom plate. It is a first object of the present invention to provide a screwed steel pile characterized in that: when the ground strength is suddenly increased, the pile can easily penetrate into the ground; and a high intensity of bearing capacity can be finally provided.

It is a second object of the present invention to provide a method of construction management of a screwed steel pile characterized in that: a bearing capacity can be easily estimated by the construction record, so that a foundation, the bearing capacity of which is more than that of a designed value, can be positively provided. Also, it is a second object of the present invention to provide a screwed steel pile characterized in that: drilled soil and sand located in a lower position of the bottom plate of the screwed pile is easily moved to an upper position of the wing, so that the penetration performance is high and the construction efficiency is enhanced.

It is a third object of the present invention to provide a method of construction of a screwed steel pile characterized in that: when the screwed steel pile is idly rotated, the problem of idle rotation of the screwed steel pile is quickly solved, so that the penetration efficiency can be enhanced and penetrate into the ground can be facilitated.

It is a fourth object of the present invention to provide a method of construction of a screwed steel pile and a device of penetrating a pipe pile characterized in that: in the case of a soft ground, soil and sand is forcibly discharged outside the pipe pile, so that the ground can be consolidated and tightened; and in the case of a hard ground, excavating can be conducted in a short period of time.

The summary of the invention will be described as follows.

The first present invention provides a screwed steel pile, the main body 1 of which is composed of a hollow pipe, a forward end of the main pile body 1 being open or closed by a bottom plate arranged on the entire face of the forward end portion, one or a plurality of wings 2 being arranged on the outside 1*a* of the forward end portion of the main pile body 1, and a forward end portion 2*a* of the wing 2 protruding downward from a face 1*b* of the forward end of the main pile body 1. In the case where a plurality of wings are provided, the lowermost wing 2 is protruded downward from a face 1*b* of the forward end of the main pile body 1.

The second present invention provides a screwed steel pile according to claim 1, wherein the forward end portion 2*a* of the wing 2 is extended in the radial direction so that it can protrude from an inside face 1*c* of the main pile body 1.

The third present invention provides a screwed steel pile according to claim 1 or 2, wherein the wing 2 is made of an abrasion resistance steel plate or a low friction steel plate.

The fourth present invention provides a screwed steel pile according to one of claims 1 to 3, wherein a excavating blade 3 is attached to a forward end portion 2*a* of the wing 2. In the case where a plurality of wings are provided, a excavating blade 3 is attached to a forward end portion 2*a* of the lowermost wing 2.

The fifth present invention provides a screwed steel pile according to one of claims 1 to 4, wherein the width of the wing 2 is changed in the circumferential direction so that the width of the forward end portion 2*a* can be narrowest and the width of the upper portion 2*b* can be widest.

The sixth present invention provides a screwed steel pile according to one of claims 1 to 5, wherein the thickness of the wing 2 is changed in the radial direction so that the inner circumferential portion 2*c* joined to the outside 1*a* of the pile body 1 becomes thickest and the outer circumferential portion 2*d* becomes thinnest.

The seventh present invention provides a screwed steel pile according to one of claims 1 to 6, wherein an end portion of the main pile body 1 located downward with respect to the wing 2 (the lowermost wing in the case of a plurality of wings) is cut off along the wing 2.

The eighth present invention provides a screwed steel pile, the main body 1 of which is composed of a hollow pipe, a forward end of the main pile body 1 being open, alternatively a forward end of the main pile body 1 being closed by a bottom plate arranged all over the forward end of the main pile body 1, one or a plurality of wings 2 being arranged on the outside 1*a* of the forward end portion of the main pile body 1 or on the forward end face 1*b* of the main pile body 1, and a portion 2*c* on the inner circumferential side of the wing 2 arranged on the forward end face 1*b* protruding from the inside 1*c* of the main pile body 1.

The ninth present invention provides a screwed steel pile, the forward end portion of the main pile body of which is provided with a bottom plate ring so that the screwed steel pile is formed into an open end pile, or the forward end portion of the main pile body of which is provided with a bottom plate so that the screwed steel pile is formed into a closed end pile, one or a plurality of wings being arranged on the outside of the lower end portion of the pile, the lower end portion of the wing being protruded downward with respect to the bottom plate ring or the bottom plate, and the protruding portion being extended in the radial direction of the pile so that the protruding portion can reach the bottom plate ring or a portion of the bottom plate or the entire bottom plate, wherein the extending portion and the protruding portion are formed into a excavation blade.

The tenth present invention provides a screwed steel pile according to claim 9, wherein the inside of the bottom plate ring is protruded from the inside face of the main pile body, and a soil and sand blocking effect generating ring is provided on the inside face of the main pile body in an upper portion of the bottom plate ring.

The eleventh present invention provides a method of construction management for managing the excavation of a screwed steel pile having one or a plurality of wings on the outside of the lower end portion of the pile, comprising the steps of: finding penetration resistance during excavation; and controlling to continue and/or complete penetration of the screwed pile according to the penetration resistance while the penetration resistance is being found.

The twelfth present invention provides a method of construction management for managing the penetration of a screwed steel pile according to claim 11, wherein penetration resistance Rp is found by the following equation.

$$Rp = \{(\cos\theta - \alpha\sin\theta)(Ht - Qwh) + (\sin\theta + \alpha\cos\theta)Lb\} / \{(1+\gamma)(\sin\theta + \alpha\cos\theta) + \alpha(Dp'/Dw')(\cos\theta - \alpha\sin\theta)\}$$

θ: Angle of a wing with respect to a face perpendicular to a pile axis

α: Coefficient of friction between a ground and a steel plate

Ht: Value obtained when torque acting on a pile end is converted into a horizontal force on an action circle Lb: Upper load acting on a pile end Dp': Diameter of an action circle of a bottom plate Dw': Diameter of an action circle of a wing Qwh: Horizontal resistance of a ground received by a cutter end γ: Coefficient of resistance of a perpendicular cutter end Rp: Penetration resistance of a ground received by a bottom plate portion which is a projected area portion of a bottom plate ring or a bottom plate The thirteenth present invention provides a method of construction management for managing the penetration of a screwed steel pile according to claim 12, wherein bearing capacity Qu of a pile end is estimated by the following equation.

$$Qu=(Rp/d)\times\{1+e(Aw/Ap)\}$$

where Aw is a projected area of a wing, Ap is a projected area of a bottom plate portion, e ($0<e\leqq 1$) is an effective working ratio of a wing portion, d is a coefficient of correction determined by a quantity of penetration at the time when a pile penetration is finished, and Qu is a bearing capacity of a pile end.

The fourteenth present invention provides a method of construction management for managing the penetration of a screwed steel pile according to claim 12, wherein pulling capacity Qup of a pile end with respect to pulling is estimated by the following expression.

$$Qup \geqq Rp - Lb$$

where Qup is a pulling capacity of a pile end with respect to pulling.

The fifteenth present invention provides a method of construction management for managing the construction of a screwed steel pile having one or a plurality of wings on the outside of the lower end portion of the pile, comprising the steps of: finding penetration resistance Rp by the following equation in the process of penetration; and controlling to continue and/or complete penetration of the screwed steel pile according to the penetration resistance while the penetration resistance is being found.

$$Rp = [2\pi Tb + Lb\{(1-c)S + cP + \alpha\pi Dw'\} - Qwh\pi Dw' - QwvS] / \{(1-c)S + cP + \alpha\pi(Dp' + Dw')\}$$

α: Coefficient of friction between a ground and a steel plate

Tb: Torque acting on a pile end

Lb: Upper load acting on a pile end

P: Wing pitch

S: Quantity of penetration per one revolution

Dp': Diameter of an action circle of a bottom plate or a bottom plate portion

Dw': Diameter of an action circle of a wing

Qwh: Horizontal resistance of a ground received by a cutter end

Qwv: Vertical resistance of a ground received by a cutter end c: Coefficient of consumed energy by a ground caused by forced deformation of a wing directed upward Rp: Penetration resistance of a ground received by a bottom plate of a bottom plate portion which is a projected area portion of the bottom plate The sixteenth present invention provides a method of construction management for managing the construction of a screwed steel pile according to claim 15, wherein bearing capacity Qu of a pile end is estimated by the following equation.

$$Qu=(Rp/d)\times\{1+e(Aw/Ap)\}$$

where Aw is a projected area of a wing, Ap is a projected area of a bottom plate or a bottom plate portion, e ($0<e\leqq 1$) is an effective working ratio of a wing, d is a coefficient of correction determined by a quantity of penetration at the time when the penetrating of a pile is finished, and Qu is a bearing capacity of a pile end.

The seventeenth present invention provides a method of construction management for managing the construction of a screwed steel pile according to claim 15, wherein pulling capacity Qup of a pile end with respect to pulling is estimated by the following expression.

$$Qup\geqq Rp-Lb$$

where Qup is a pulling capacity of a pile end with respect to pulling.

The eighteenth present invention provides a method of construction of a screwed steel pile comprising the steps of: rotating a screwed steel pile having a wing at the forward end portion so as to penetrate the screwed steel pile into the ground; reversing the screwed steel pile so as to draw it by an appropriate distance when a quantity of penetration of the a screwed steel pile is remarkably decreased; and rotating the screwed steel pile again so as to penetrate it into the ground.

The nineteenth present invention provides a method of construction of a screwed steel pile comprising the steps of: rotating a screwed steel pile having a wing at the forward end portion so as to penetrate the screwed steel pile into the ground; reversing the screwed steel pile so as to draw it by a distance at least not less than a pitch of the wing when a quantity of penetration of the screwed steel pile is remarkably decreased; and rotating the screwed steel pile again so as to penetrate it into the ground under the condition that a pile head is given a load directed downward.

The twentieth present invention provides a method of construction of a screwed steel pile, in which the inside-drilling method is also used, comprising the steps of: drilling, rotating and penetrating the screwed steel pile on a soft layer of a ground and discharging drilled soil and sand to a periphery of the pile so that the drilled soil and sand cannot enter the pile; and conducting inside-drilling on a hard intermediate stratum or a support stratum so that the drilled soil and sand can enter the pile.

The twenty first present invention provides a method of construction of a screwed steel pile described above, wherein drilled soil and sand is made to enter the screwed steel pile by the inside-drilling method when the screwed steel pile is penetrated into a support stratum, and solidification material such as cement mortar or cement milk is jetted out from an end of the auger so that the jetted solidification material is solidified and integrated with the forward end portion of the screwed steel pile, and the screwed steel pile is supported by and fixed to the support stratum of the ground.

The twenty second present invention provides a method of construction of a screwed steel pile comprising the steps of: inserting an auger used for inside-drilling having a spiral wing of an appropriate length into the screwed steel pile, the end of which is open having a drilling wing outside of the forward end of the screwed steel pile body, from the lower side, the rotation of the auger being controlled separately from the rotation of the pile; rotating and penetrating the pile into a soft stratum of the ground so as to drill soil and sand by the drilling wing and forcibly discharge the drilled soil and sand to the periphery of the pile body, the rotation of the auger being stopped during penetrating the pile so that soil and sand cannot enter the pile; and drilling and rotating the auger on a hard stratum of the ground such as an intermediate stratum and a support stratum of the ground so that the drilled soil and sand can enter the pile.

The twenty third present invention provides a method of construction of a screwed steel pile comprising the steps of: using a screwed steel pile, the end portion of which is open, having a drilling wing for drilling a ground, arranged outside in a lower portion of the pile, also using an auger having a spiral wing for drilling of an appropriate length, mounted on an auger shaft inserted into the pile, also using a pipe pile drive section for rotating the pile, and also using an auger drive section for rotating the auger in the normal and the reverse direction; drilling, rotating and penetrating the pile into a soft stratum of the ground so as to drill soil and sand by the drilling wing and forcibly discharge the drilled soil and sand to the periphery of the pile body, the rotation of the auger being stopped during penetrating the pile so that soil and sand cannot enter the pile; drilling and rotating the auger on a hard stratum of the ground such as an intermediate stratum and a support stratum of the ground so that the drilled soil and sand can enter the pile; and drawing out the auger from the pile after the completion of penetration of the pipe pile.

BRIEF DESCRIPTION OF THE DRAWINGS

FIG. 1(*b*) is a bottom side view of the screwed steel pile, the end of which is open, shown in FIG. 1(*a*).

FIG. 3(*b*) is a bottom side view of the screwed steel pile, the end of which is open, shown in FIG. 3(*a*).

FIG. 4(*c*) is a front view showing still another embodiment of the fourth embodiment of the present invention. FIG. 4(*d*) is a front view showing still another embodiment of the fourth embodiment of the present invention.

FIG. 5(*b*) is a front view showing another example of the configuration of a excavating blade welded at a forward end portion of a wing in the embodiment of the present invention. FIG. 5(*c*) is a bottom side view of FIG. 5(*b*).

FIG. 10 is a view showing a relation between a face not to be drilled and a wing in a steady condition.

FIG. 14(*b*) is a graph showing a result of the measurement of a change in the penetrative resistance in the second embodiment of the present invention. FIG. 14(*c*) is a graph showing a result of the measurement of a change in the penetrative resistance in the third embodiment of the present invention.

FIG. 18(*b*) is a perspective view taken from the lower side of a screwed steel pile of another embodiment.

FIG. 19 is a schematic illustration showing a state of energy inputted into or released from the pile head portion or the bottom plate portion.

FIG. 20(*b*) is a graph showing a result of the measurement of a change in the penetrative resistance in the second embodiment of the present invention.

FIG. 24 is a process diagram of construction.

THE MOST PREFERRED EMBODIMENT

Figure 1:
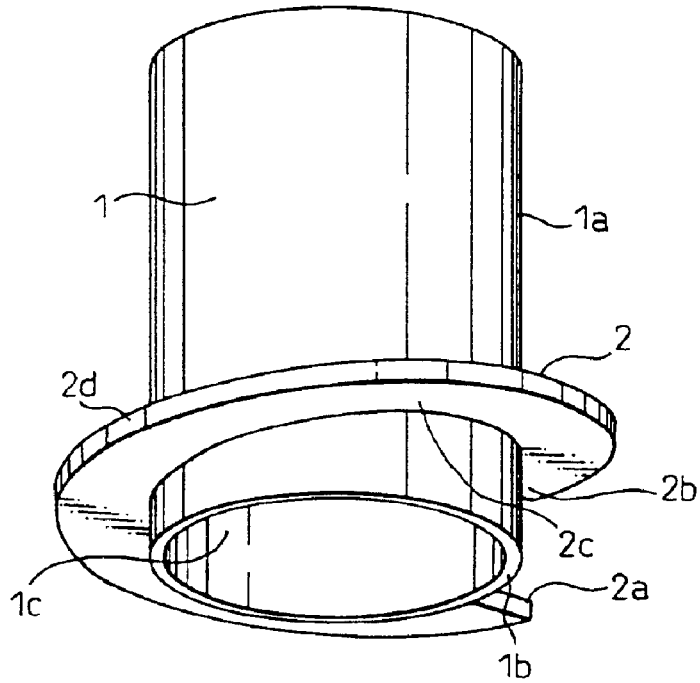
FIG. 1(*a*) is a perspective view of a forward end portion of a screwed steel pile, the end of which is open, of the first embodiment of the present invention, wherein the view is taken from the lower side.
Figure 1:
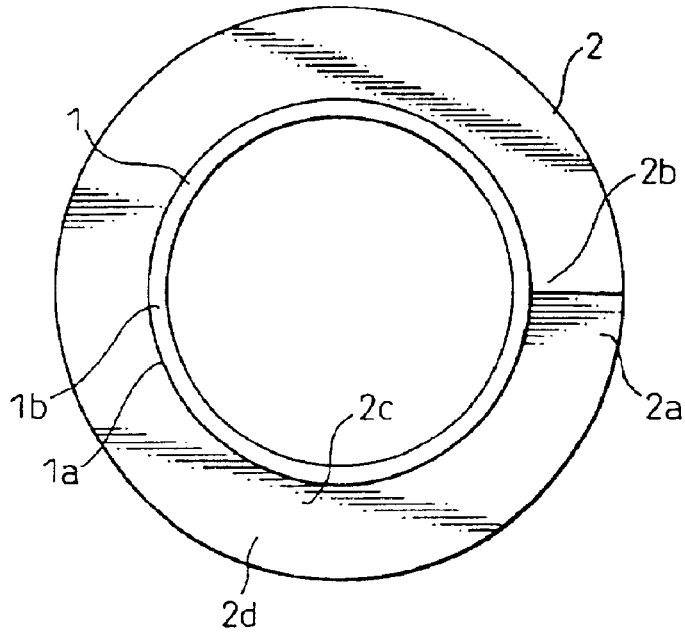

In the embodiment shown in FIGS. 1(*a*) and 1(*b*), one piece of one roll of the spiral wing 2 made of a steel plate is welded onto the outside 1*a* at the forward end portion of the pile body 1 composed of a steel pipe. The forward end portion 2*a* of the wing 2 is arranged at the same level as that of the forward end face 1*b* of the pile body 1. Vickers Hardness (HV) of mild steel is usually 120 to 150. On the other hand, Vickers Hardness (HV) of abrasion resistance steel is higher than 300 because abrasion of the wing is restrained in a deep depth and excavation performance is maintained. Furthermore, the use of this kind of steel is more effective to restrain the increase of the coefficient of friction between the steel wing and the soil and the sand. Therefore, it is effective to use an abrasion resistance steel plate for the wing. In this case, abrasion resistance steel or an abrasion resistance steel plate is defined as steel or a steel plate stipulated by JTS G3115, JIS G3106, JIS G3120, JIS G3128, SPV 450N, SPV 450Q and SM 570Q.

Figure 2:
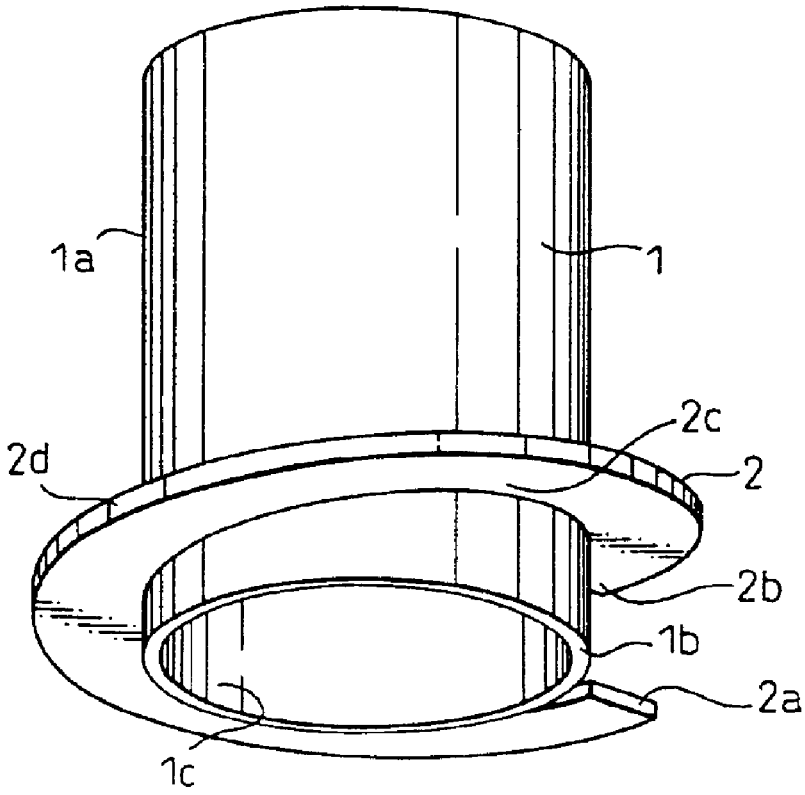
FIG. 2 is a perspective view of a forward end portion of a screwed steel pile, the end of which is open, of the second embodiment of the present invention, wherein the view is taken from the lower side.

In the embodiment shown in FIG. 2, one piece of one roll of the spiral wing 2 made of a low friction steel plate is welded onto the outside 1*a* at the forward end portion of the pile body 1 composed of a steel pipe. The forward end portion 2*a* of the wing 2 protrudes downward from the forward end face 1*b* of the pile body 1 by a distance corresponding to the thickness of the wing 2. A coefficient ($\alpha$) of friction between soil (sand) and mild steel usually fluctuates in a range from 0.3 to 0.6. A relation between necessary torque (Tr) and coefficient ($\alpha$) of friction is expressed by the equation of $Tr=x\alpha+b$. Usually, b is lower than $x\alpha$. Therefore, the coefficient of friction has a great influence on the torque. For the above reasons, it is effective to use a low friction steel plate for the wing.

Figure 3:
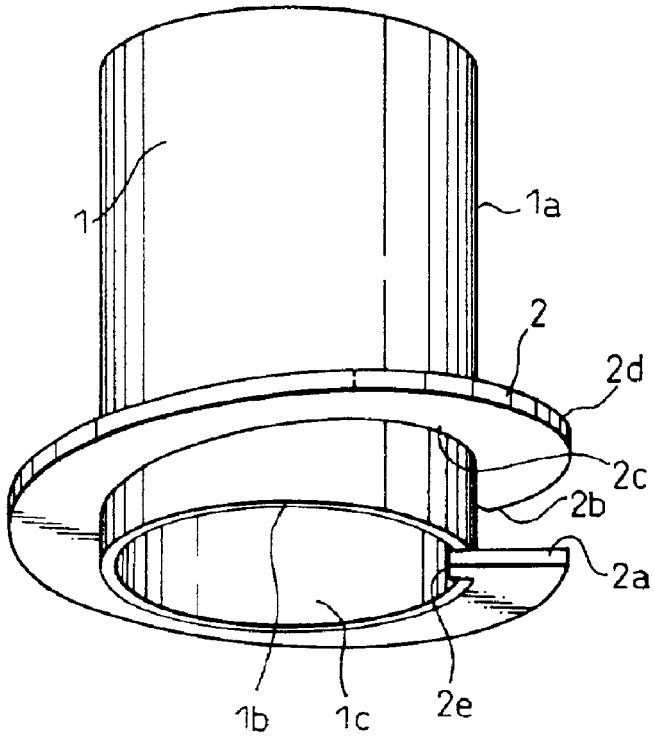
FIG. 3(*a*) is a perspective view of a forward end portion of a screwed steel pile, the end of which is open, of the third embodiment of the present invention, wherein the view is taken from the lower side.
Figure 3:
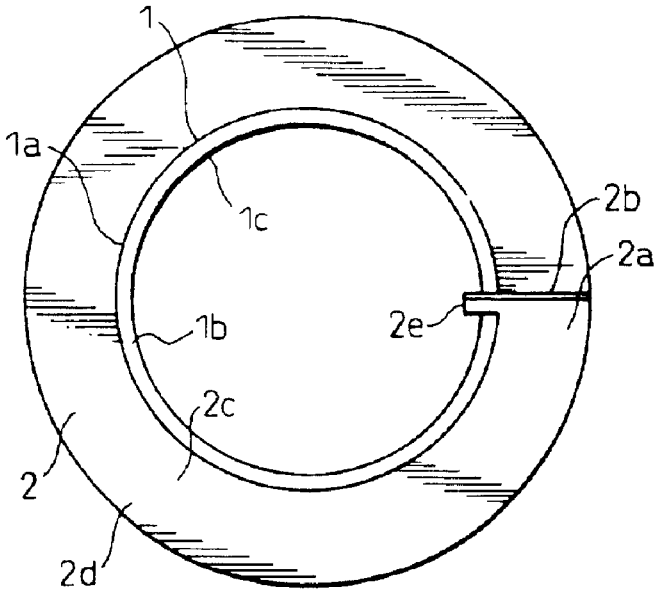

In the embodiment shown in FIGS. 3(*a*) and 3(*b*), one piece of one roll of the spiral wing 2 made of a steel plate is welded onto the outside 1*a* at the forward end portion of the pile body 1 composed of a steel pipe. The forward end portion 2*a* of the wing 2 protrudes downward from the forward end face 1*b* of the pile body 1 by a distance corresponding to the thickness of the wing 2. The inside end portion 2*e* of the forward end portion 2*a*of the wing 2 crosses the forward end face 1*b* of the pile body 1 and protrudes to a lower side space in the hollow portion of the pile body 1.

Figure 4:
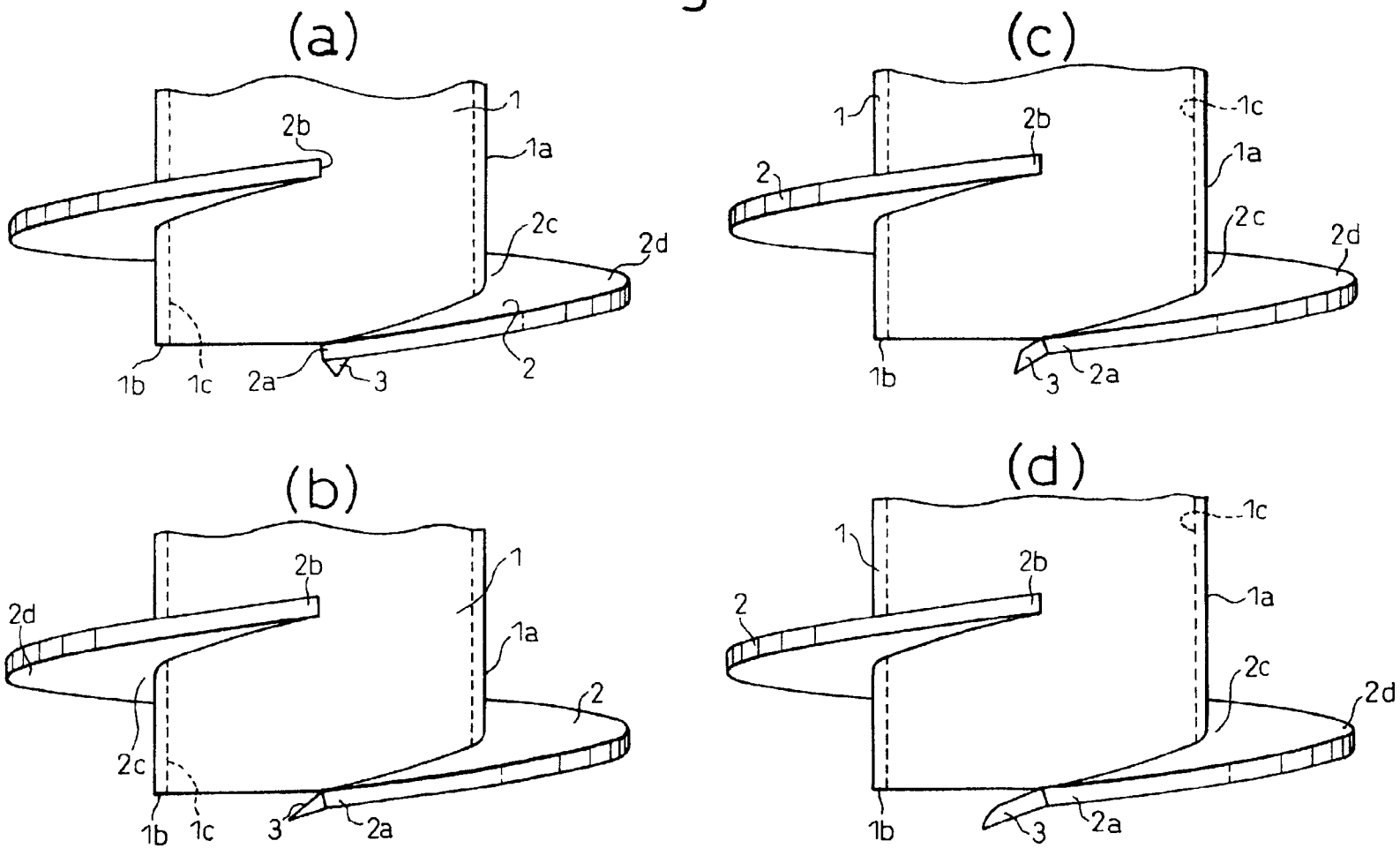
FIG. 4(*a*) is a front view of a forward end portion of a screwed steel pile, the end of which is open, of the fourth embodiment of the present invention, FIG. 4(*b*) is a front view showing another embodiment of the fourth embodiment of the present invention.

In the embodiment shown in FIGS. 4(*a*) to 4(*d*), one piece of one roll of the spiral wing 2 made of a steel plate is welded onto the outside 1*a* at the forward end portion of the pile body 1 composed of a steel pipe. The forward end portion 2*a* of the wing 2 protrudes downward from the forward end face 1*b* of the pile body 1 by a distance corresponding to the thickness of the wing 2. The excavating blade 3 is welded onto the lower face of the forward end portion 2*a* of the pile body 1. A configuration of this excavating blade 3 can be changed as shown in FIGS. 4(*c*) and 4(*d*). When an abrasion resistance steel plate is used for the excavating blade 3, it is possible to provide a higher effect. As shown in FIG. 4(*d*), a tip of the excavating blade 3, which is formed integrally with or separately from the wing, may be subjected to hot working, and after that, it may be subjected to heat-treatment.

Figure 5:
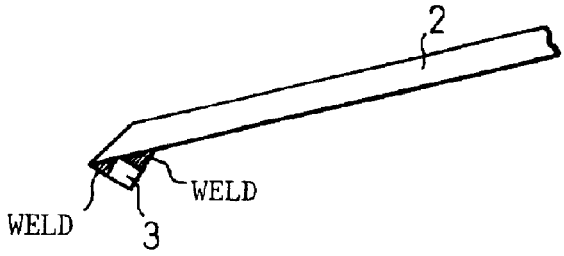
FIG. 5(*a*) is a front view showing an example of the configuration of a drilling bit welded at a forward end portion of a wing in an embodiment of the present invention.
Figure 5:
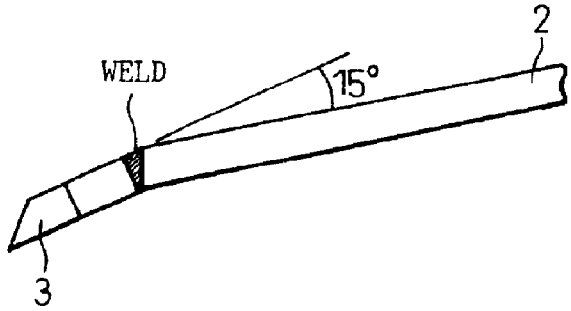
Figure 5:
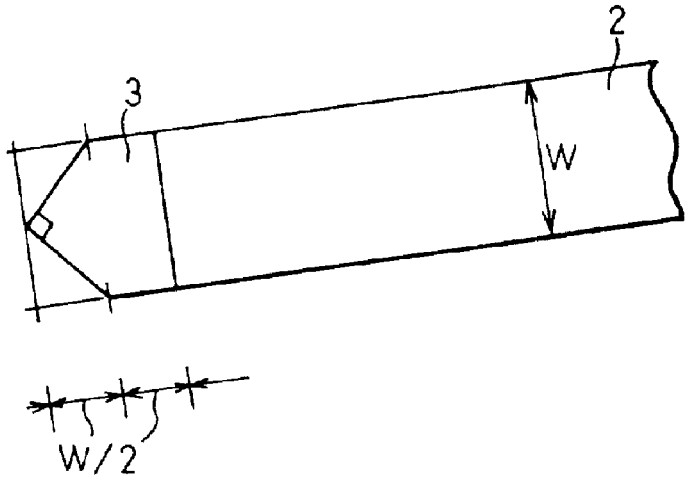

An example of the configuration of the excavating blade welded at the end of the wing is shown in FIG. 5(*a*), and other examples are shown in FIGS. 5(*b*) and 5(*c*), however, it should be noted that the present invention is not limited to the above specific examples.

Figure 6:
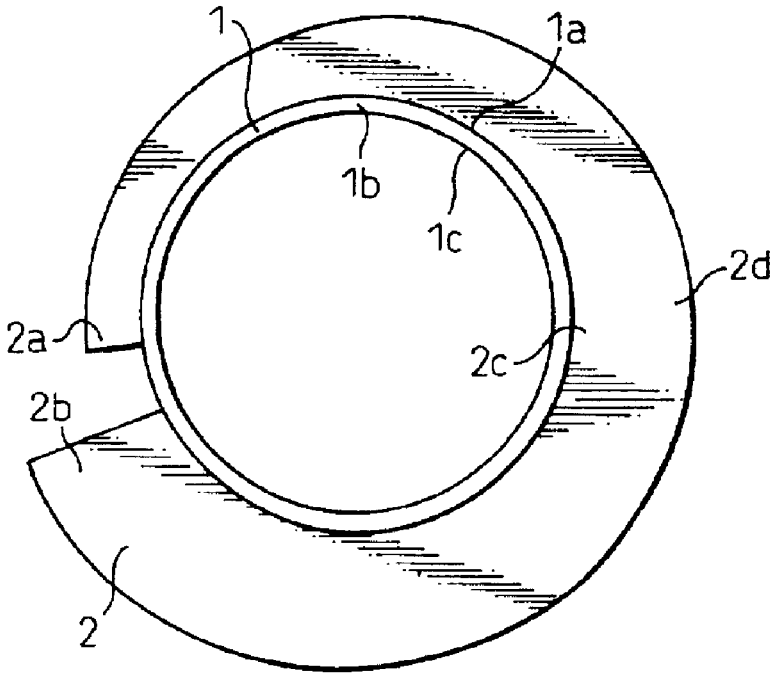
FIG. 6 is a bottom side view of a screwed steel pile, the end of which is open, of the fifth embodiment of the present invention.

In the embodiment shown in FIG. 6, one piece of one roll of the spiral wing 2 made of a steel plate is welded onto the outside 1*a* at the forward end portion of the pile body 1 composed of a steel pipe. The forward end portion 2*a* of the wing 2 is arranged at the same level as that of the forward end face 1*b* of the pile body 1. The width of the wing 2 is changed in the circumferential direction in such a manner that the width of the forward end portion 2*a* of the wing 2 is narrowest. In this embodiment, the width of the forward end portion 2*a* is half of the width of the upper end portion 2*b* of wing 2.

Figure 7:
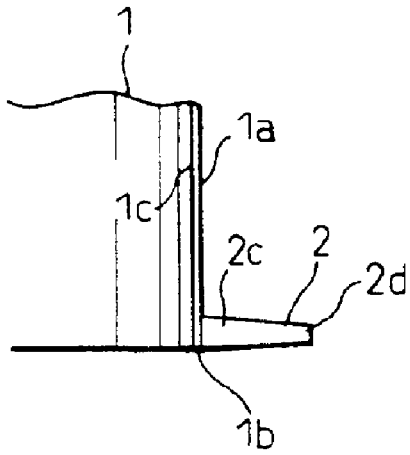
FIG. 7 is a vertical cross-sectional view of a forward end portion of the screwed steel pile, the end of which is open, shown in FIG. 1.

In the embodiment shown in FIG. 7, the forward end portion 2*a* of the wing 2 is arranged at the same level as that of the forward end face 1*b* of the pile body 1. The width of the inner circumferential portion 2*c* welded onto the outside 1*a* of the pile body 1 is thickest, and the width of the outer circumferential portion 2*d* is thinnest. A vertical cross-section of the wing is the same as a trapezoid which is set sideways.

Figure 8:
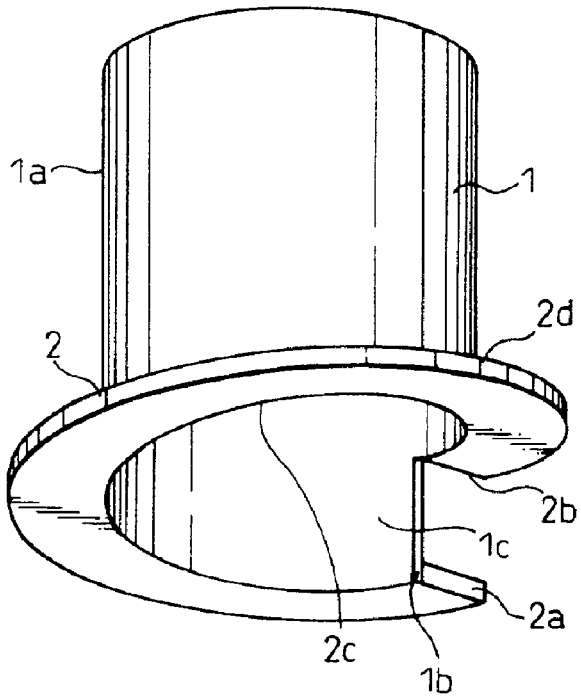
FIG. 8 is a perspective view of a forward end portion of the screwed steel pile, the end of which is open, of the seventh embodiment of the present invention, wherein the view is taken from the lower side.

In the embodiment shown in FIG. 8, one piece of one roll of the spiral wing 2 made of a steel plate is welded onto the outside 1*a* at the forward end portion of the pile body 1 composed of a steel pipe. The forward end portion 2*a* of the blade 2 is arranged at the same level as that of the forward end face 1*b* of the pile body 1. An end portion of the pile body 1 on the lower side of the wing 2 is spirally cut off along the lower face of the wing 2.

Figure 9:
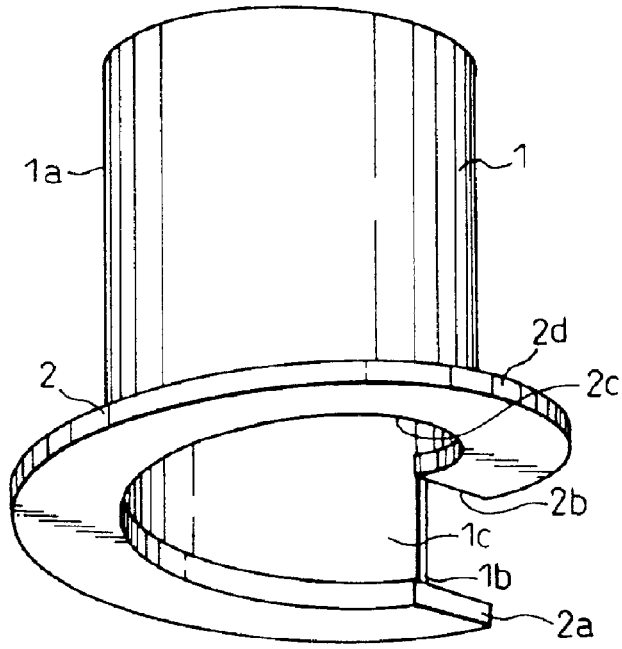
FIG. 9 is a perspective view of a forward end portion of the screwed steel pipe, the end of which is open, of the eighth embodiment of the present invention, wherein the view is taken from the lower side.

In the embodiment shown in FIG. 9, an end portion of the pile body 1 composed of a steel pipe is spirally cut off, and one piece of one roll of the spiral wing 2 made of a steel plate is welded onto the forward end face 1*b* of the pile body 1. An inside radius of the wing 2 is smaller than that of the pile body 1. Therefore, the inner circumferential portion 2*c* of the wing 2 protrudes from the inside 1*c* of the pile body 1.

Next, the construction management method, which is applied to an actual penetration of the above screwed steel piles, will be explained as follows.

The present inventors analysed and investigated, many times, the penetration mechanism of the screwed steel pile. As a result, they found that a good correlation exists between N-SPT value and torque so that the penetrative resistance can be found by giving torque and load to the pile in the process of construction. In this way, the present invention was accomplished by the present inventors.

As a pre-stage of this construction management method, the penetration mechanism of the screwed steel pile was made clear by the present inventors as follows.

Figure 10:
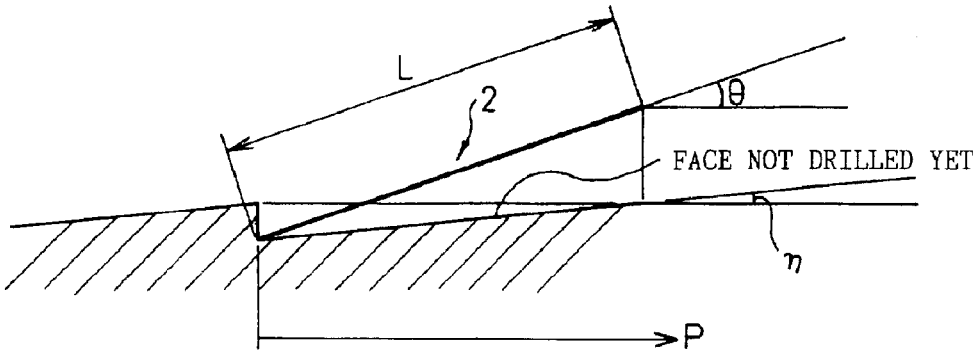
FIG. 10 is a view for explaining a penetration mechanism of a screwed steel pile of the present invention, that is.

AS shown in FIG. 10, when the spiral wing 2 is developed along axis p (circumferential axis) passing at the substantially intermediate point of the wing 2 in the width direction and set on a vertical face, it can be expressed by a straight line, the length of which is L. In the case of a steady state, a relation between the wing and the face, which has not been drilled yet, can be analyzed as follows.

Figure 12:
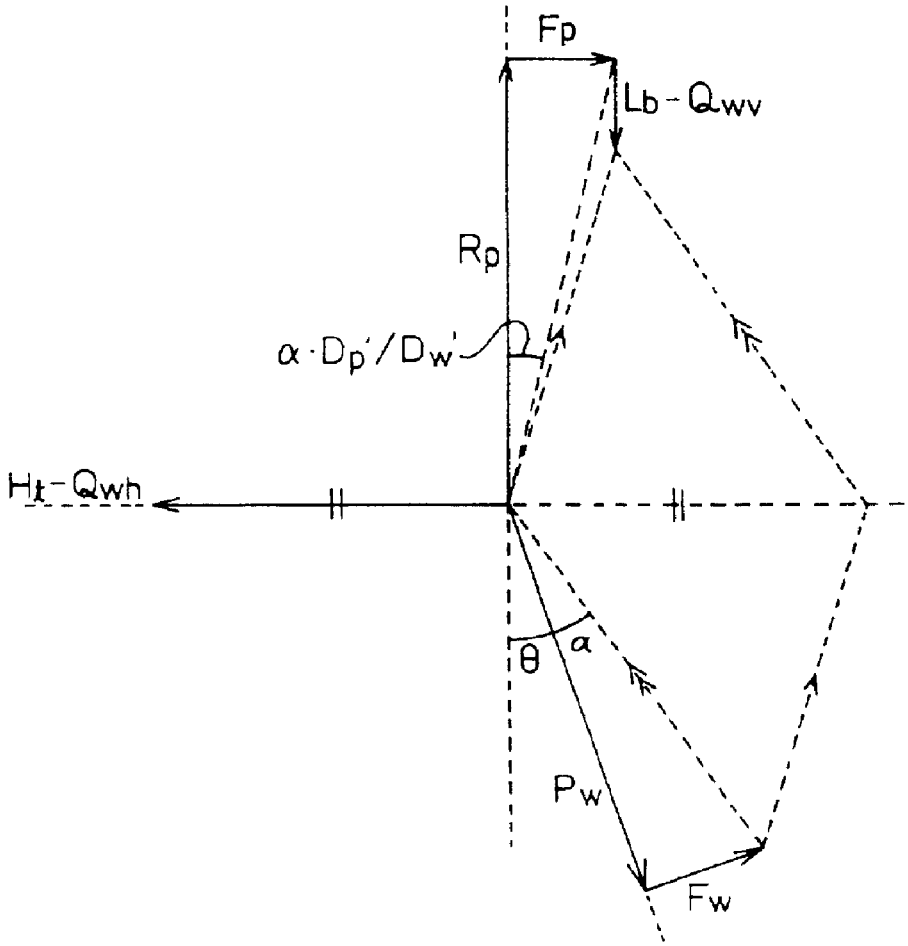
FIG. 12 is a vector diagram showing a balance of forces in the penetration mechanism shown in FIG. 10.

When terminologies and marks are defined as follows, forces given to the wing and the bottom plate portion can be analyzed as shown in FIG. 12 as follows.

In the present invention, terminologies are defined as follows.

Wing:

The wing is a doughnut-shaped steel plate or a portion of the doughnut-shaped steel plate which is fixed onto the outside of the lower end portion of a pile body composed of a steel pipe. The configuration of the wing is spiral or flat, and the number of the wing is one or plural.

Bottom Plate:

The bottom plate is a disk-shaped steel plate for closing the entire face of the forward end opening portion of the pile body. This bottom plate is used for a pile, the end portion of which is closed.

Bottom Plate Ring:

The bottom plate ring is a doughnut-shaped steel plate for closing a portion of the forward end opening of the pile body. This bottom plate ring is used for a pile, the end of which is open.

Bottom Plate Portion:

The bottom plate portion is a projected area portion of the bottom plate or the bottom plate ring.

Closing Effect Generating Ring:

The closing effect generating ring is a doughnut-shaped steel plate arranged in the pile body. This closing effect generating ring facilitates the blocking effect of earth and sand entering the pile body.

Protruding Portion:

The protruding portion is a lower end portion of the wing protruding to a lower end of the bottom plate or the bottom plate ring.

Extending Portion:

The extending portion is a portion of the bottom plate or the bottom plate ring which is entirely or partially extended in the radial direction.

Excavating Blade:

The excavating blade is a protruding portion and an extending portion of the lower end of the blade.

Upper Self-Load:

The upper self-load is the self-weight of a heavy construction machine (motor) which is put at the top portion of the pile.

Pushing Load:

The pushing load is a load given to a pile in the perpendicular direction by a pushing device of a pile driver.

Upper Load:

The upper load is a resultant force of the upper self-load and the pushing load.

Torque:

Torque is a rotating force generated by a motor or a twisting force acting on the pile body.

Quantity of Penetration (Quantity of Settlement):

Quantity of penetration is a quantity of penetration of a screwed steel pile when it is turned by one revolution in the process of construction Thrust:

Thrust is a force given to a pile in the downward direction of the normal line of a wing when the a pile is rotated in the process of construction Force of Penetration:

In general, force of penetration is a force acting in the downward direction when a pile is buried. Strictly speaking, force of penetration is a value obtained when torque is divided by a quantity of settlement.

Penetrative Resistance:

Penetrative resistance is a force of reaction given to the bottom plate portion of a pile from a ground when the pile is penetrated into the ground Blade Resistance:

Blade resistance is a force of reaction given to a blade from a ground when a pile is penetrated into the ground Face of Ground which has not Been Drilled Yet:

It is a face of ground which has not been drilled yet by a bottom plate portion or a wing Soil in Pipe:

Soil in pipe is soil and sand which has entered a steel pipe composing a pile having an open end In the present invention, marks are defined as follows.

A: Projected area calculated by $Dw=\pi Dw^2/4=Aw+Ap$

Aw: Projected area of wing$=\pi\{(Dw/2)^2-(Do/2)^2\}$

Awp: Area corresponding to resistance of perpendicular blade

Ap: Projected area at bottom portion$=\pi\{(Do/2)^2-(Di/2)^2\}$

However, when an end portion is closed in the case of a pile having an open end, and when a pile having a closed end is used, Di=0

Dw': Diameter of an action circle (circle on which a resultant force in the rotational direction is acting) of wing= $[2\times(Dw^3-D^3)]/[3\times(Dw^2-Do^2)]$ Dp': Diameter of an action circle of a bottom plate or a bottom plate portion=(2/3)Do Di: Inner diameter of the inside of a bottom plate ring, or inner diameter of a steel pipe in the case where no bottom plate ring is provided Do: Outside diameter of a pile body Dw: Outside diameter of a wing Fp: Frictional force acting on a bottom plate portion=αRp Fw: Frictional force acting on an upper face of a wing=αPw Ht: Value obtained when torque acting on an end of a pile is converted into a horizontal force on an action circle=Tb/(DW'/2)

L: Blade length on an action circle=πDw'/cos θ

Lt: Upper load acting on an top of a pile

Lb: Upper load acting on an end of a pile=aLt

Pw: Thrust

Qu: Bearing capacity of a forward end of a pile

Qup: pulling capacity with respect to pulling out a forward end of a pile

Qwh: Horizontal resistance of a ground given to a blade

Qwv: Resistance of a perpendicular blade=γRp

Figure 11:
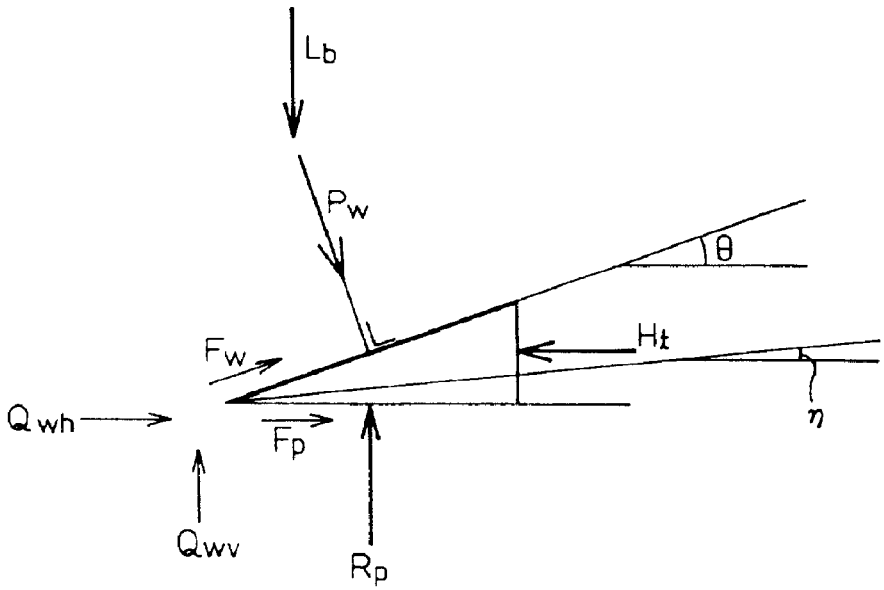
FIG. 11 is a schematic illustration showing a dynamic state of forces acting on the wing and the bottom plate in the penetration mechanism shown in FIG. 10.

Rp: Penetrative resistance of a ground given to a bottom plate ring or a bottom plate portion which is a projected area portion of a bottom plate S: Quantity of penetration per one revolution Tt: Torque acting on a top of a pile Tb: Torque acting on a lower end of a pile=aTt α: Coefficient of friction between a ground and a steel plate γ: Coefficient of resistance of a perpendicular blade=Awp/Ap η: Penetration angle θ: Angle of a wing formed between the wing and a face perpendicular to a central axis ϕ: Internal frictional angle of a ground a: Transfer ratio of upper load Lt and torque Tt to an end of a pile c: Coefficient determined by an upward forced deformation of a wing d: Coefficient of correction determined by a quantity of penetration at the time when driving of a pile is stopped e: an effective working ratio of a wing portion g: Ratio of blockade of a bottom plate portion FIG. 12 is a vector diagram on which a dynamic state of forces acting on the wing and the bottom plate portion shown in FIG. 11 is expressed.

$$Fp=\alpha(Dp'/Dw')Rp \tag{1}$$

$$Fw=\alpha Pw \tag{2}$$

The balance of forces can be expressed as follows.

$$Ht-Qwh=\alpha(Dp'/Dw')Rp+Pw\sin\theta+\alpha Pw\cos\theta \tag{3}$$

$$Rp-Lb+Qwv=Pw\cos\theta-\alpha Pw\sin\theta \tag{4}$$

The following equation can be introduced from equation (3).

$$Ht-Qwh-\alpha(Dp'/Dw')Rp=Pw(\sin\theta+\alpha\cos\theta) \tag{5}$$

The following equation can be introduced from equation (4).

$$Rb-Lb+Qwv=Pw(\cos\theta-\alpha\sin\theta) \tag{6}$$

When Pw is eliminated from equations (5) and (6), the following equation can be obtained.

$$\{Ht-Qwh)-\alpha(Dp'/Dw')Rp\}(\cos\theta-\alpha\sin\theta)=(Rp=Lb+Qwv)(\sin\theta+\alpha\cos\theta) \tag{7}$$

Rp is introduced from equation (7).

$$(Ht-Qwh)(\cos\theta-\alpha\sin\theta)-\alpha(Dp'/Dw')(\cos\theta-\alpha\sin\theta)Rp=(\sin\theta+\alpha\cos\theta)Rp-(Lb-\gamma Rp)(\sin\theta+\alpha\cos\theta)$$

$$\{(1+\gamma)(\sin\theta+\alpha\cos\theta)+\alpha(Dp'/Dw')(\cos\theta-\alpha\sin\theta)\}Rp=(Ht-Qwh)(\cos\theta-\alpha\sin\theta)+Lb(\sin\theta+\alpha\cos\theta)$$

In this way, the following logistic equation can be obtained.

$$Rp=\{(\cos\theta-\alpha\sin\theta)(Ht-Qwh)+(\sin\theta+\alpha\cos\theta)Lb\}/\{(1+\gamma)(\sin\theta+\alpha\cos\theta)+\alpha(Dp'/Dw')(\cos\theta-\alpha\sin\theta)\} \tag{8}$$

As shown in equation (8), intrusion resistance Rp is calculated by: coefficient α, and horizontal blade resistance Qwh; inclination angle θ of a wing determined by a configuration, diameter Dp' of an action circle of a bottom plate ring, diameter Dw' of an action circle of a wing, and coefficient γ; and torque Tt measured as a record of construction management, and an upper load Lt. These parameters can be measured on the ground at any time before construction or in the process of construction with respect to an open pipe end and a closed pipe end. Therefore, quality of the foundation pipe can be highly reliably guaranteed.

Forward end bearing capacity Qu of a pile disclosed in the thirteenth present invention can be found by the following equation.

$$Qu=(Rp/d)\times\{1+e(Aw/Ap)\} \tag{9}$$

As shown in the above equation (9), forward end bearing capacity Qu of a pile can be calculated by: coefficient α and horizontal cutter resistance Qwh; inclination angle θ of a wing determined by a configuration, diameter Dp' of an action circle of a bottom plate ring, projected area Aw of a wing, projected area Ap of a bottom plate portion, diameter Dw' of an action circle of a wing, and coefficient γ; and torque Tt measured as a record of construction management, and an upper load Lt. These parameters can be measured on the ground at any time before construction or in the process of construction. Therefore, quality of the foundation pipe can be highly reliably guaranteed. Coefficient d and ratio e are given by a function of intrusion angle η, and the changing ranges are $0<d\leqq 1$, and $0<e\leqq 1$. When these values are used, it is possible to estimate Qu by equation (9), Forward end pulling capacity Qup with respect to pulling of a pile disclosed in the fourteenth present invention can be found by the following equation.

$$Qup\geqq Rp-Lb \tag{10}$$

As shown in the above equation (10), forward end proof strength of a pulling capacity Qup of a pile with respect to pulling can be calculated by: coefficient α and horizontal blade resistance Qwh; inclination angle θ of a wing determined by a configuration, diameter Dp' of an action circle of a bottom plate ring, diameter Dw' of an action circle of a wing, and coefficient γ; and torque Tt measured as a record of construction management, and an upper load Lt. These parameters can be measured on the ground at any time before construction or in the process of construction. Therefore, quality of the foundation pipe can be highly reliably guaranteed.

Construction of the screwed steel pile according to the present invention will be explained below based on FIG. 13 and FIG. 18. This screwed steel pile is drilled into the ground as follows. While the pile body 1 is being rotated by a motor of a heavy construction machine which is put at the top portion of the pile body 1, the pile body 1 is penetrated into the ground by a pushing device of the pile driver. Since the excavating blade 3 composed of the protruding portion 2*a* and the extending portion 2*d* of the wing is protruding downward to a lower portion of the pile body 1, soil and sand at the forward end of the pile is weakened by the excavating blade 3. The thus drilled soil and sand is easily moved to an upper portion of the main body of the wing 2 which continues to the excavating blade 3. Therefore, the force of excavation can be regenerated.

Figure 19:
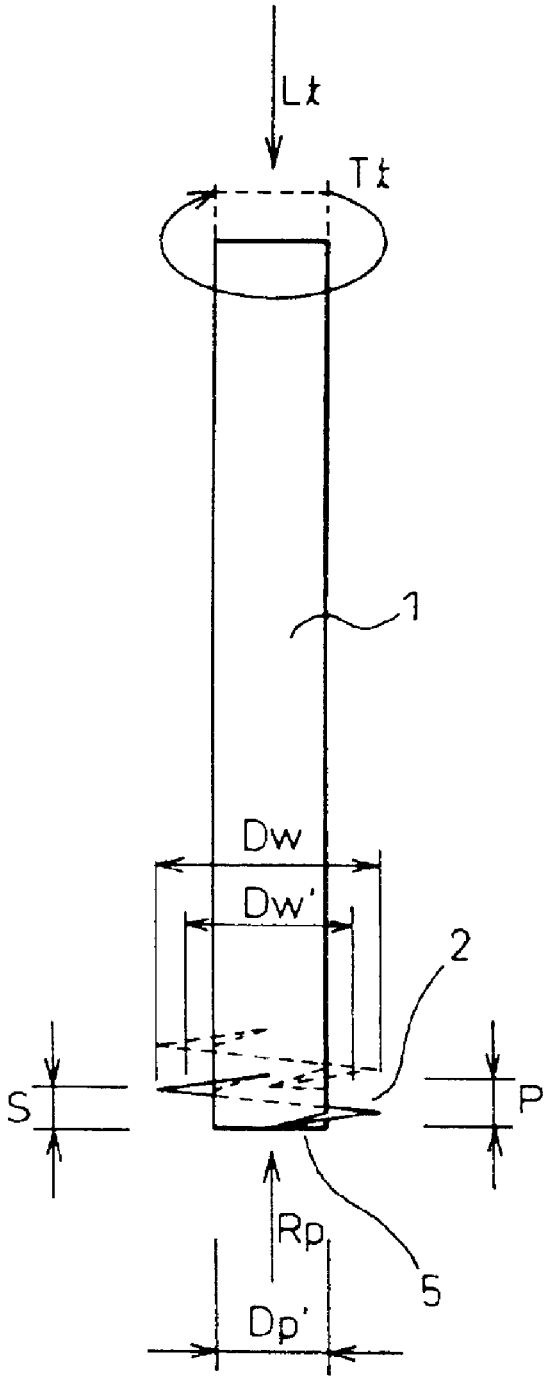
FIG. 19 is a schematic illustration for explaining the penetration mechanism of the screwed steel pile of the present invention, that is.

In the case of a pile, the end portion of which is open, the projected area of the bottom plate ring 5 composes a support bottom portion of the pile, and in the case of a pile, the end portion of which is closed, the projected area of the bottom plate 4 composes a support bottom portion of the pile. As shown in FIG. 19, a force of reaction given by the ground, that is, penetrative resistance Rp acts on the above support bottom portion.

Figure 16:
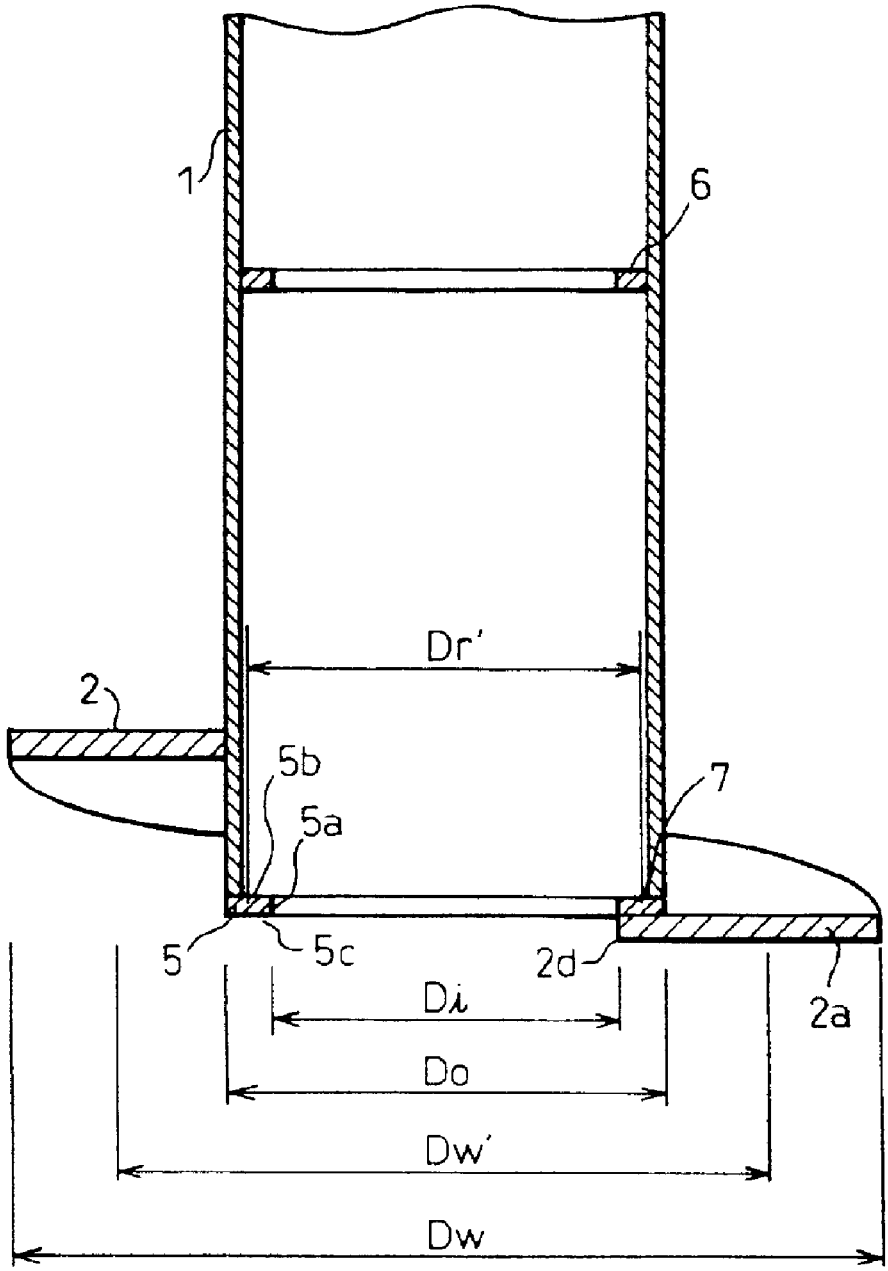
FIG. 16 is a cross-sectional view taken on line A—A in FIG. 15.

The screwed steel pile according to the present invention will be explained below. In this screwed steel pile, as shown in FIGS. 13 and 16, the inside 5*a* of the bottom plate ring 5, which is a doughnut-shaped disk, protrudes to the pile center side compared with the inside 1*a* of the pile body 1. Therefore, the corner portion 7, which is recessed, is formed by the upper face 5*b* of the bottom plate ring 5 and the inside 1*a* of the pile body. Due to the above structure, soil and sand on the lower face 5*c* side of the bottom plate ring 5 is not excessively compressed and restricted but smoothly pushed into the pile body 1.

In the case where a soft layer exists on a hard bearing stratum, soil and sand, which has been pushed into the pile body 1 when the pile body 1 passes through the soft layer, is pushed out by soil and sand which has been pushed when the pile body 1 passes through the hard bearing stratum. Therefore, the soil and sand is discharged from the central opening of the soil and sand blocking effect generating ring 6.

The blocking effect generating ring 6 functions as a stopping means for stopping soil and sand on the bearing stratum. The thus compressed soil and sand on the bearing stratum, which has been shut up in the pile body between the bottom plate ring 5 and the blocking effect generating ring 6, composes a support bottom portion of the pile which receives penetrative resistance Rp together with the bottom plate ring 5.

The screwed steel pile of the present invention, the end of which is open, includes both a pile having a bottom plate ring and a pile having no bottom plate ring. In the case of the pile having the bottom plate ring 5, the end of which is open, the bottom plate portion means both the bottom plate ring and the soil and sand in the pile. In the case of the pile having no bottom plate ring 5, the end of which is open, it is assumed that a bottom plate ring, the width of which is the same as the wall thickness of the steel pipe, is provided at the forward end portion of the pile, that is, the forward end portion of the pile is substituted by the bottom plate ring, and the bottom plate portion is composed of the forward end portion of the pile and the soil and sand in the pipe.

First of all, the construction method of the screwed steel pile will be explained referring to FIG. 19. While the pile body 1 is being rotated by a motor (not shown) of a heavy construction machine which has been put at the top portion of the pile body 1, the pile body 1 is pushed into the ground by a pushing device (not shown) of a pile driver. Due to the foregoing, the entire pile is penetrated into the ground in accordance with quantity S of penetration.

Figure 13:
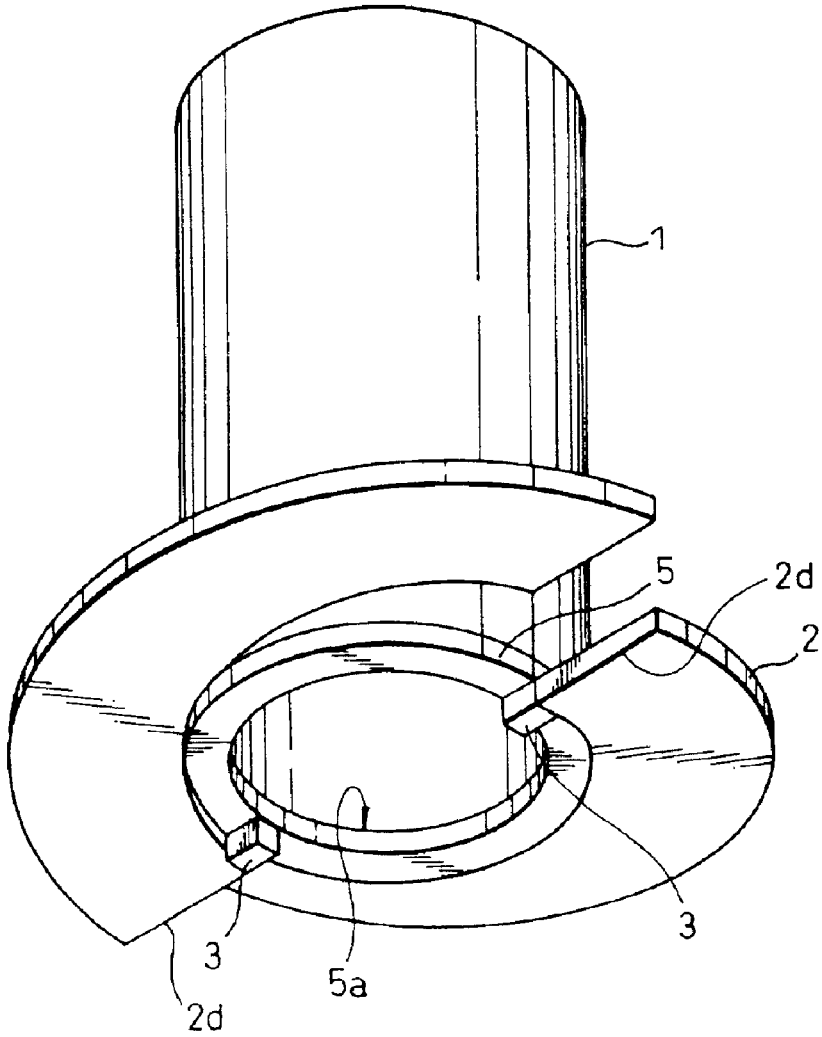
FIG. 13 is a perspective view of a screwed place pile having two spiral wings of the present invention, wherein the view is taken from the lower side.

At this time, in the case of the pile shown in FIG. 13, the end of which is open, the projected area portion of the bottom plate ring 5 and the soil and sand in the pipe compose a support bottom portion of the pile. In the case of the pile shown in FIG. 18(*a*), the end of which is closed, the projected area portion of the bottom plate 4 composes a support bottom portion. A force of reaction, that is, penetrative resistance Rp acts on the support bottom portion. In this case when the soil and sand in the pipe is not blocked in the pile shown in FIG. 13, the end portion of which is open, projected area portion Ap is found by the following equation.

$$Ap=\pi\{(Do/2)^2-(Di/2)^2\}$$

Figure 18:
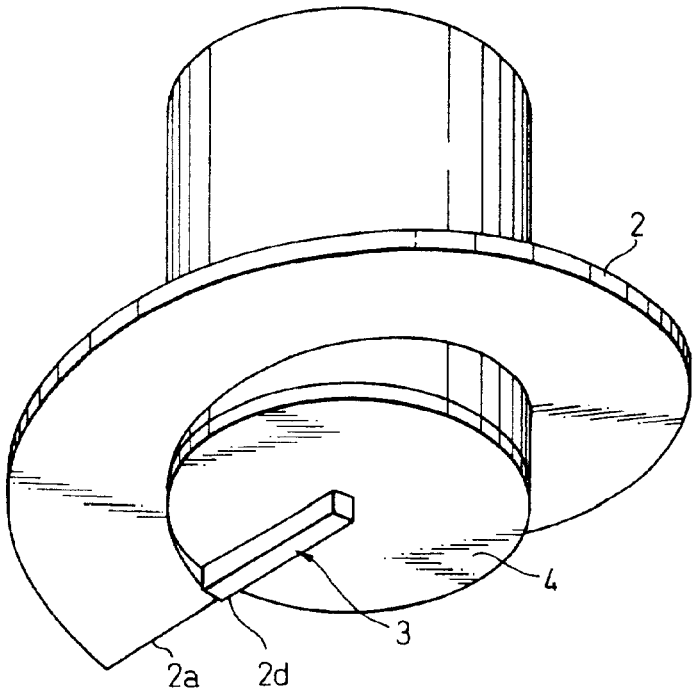
FIG. 18(*a*) is a perspective view taken from the lower side of the screwed steel pile of the closed end system of the sixth embodiment of the present invention, wherein one spiral wing is used in the pile.
Figure 18:
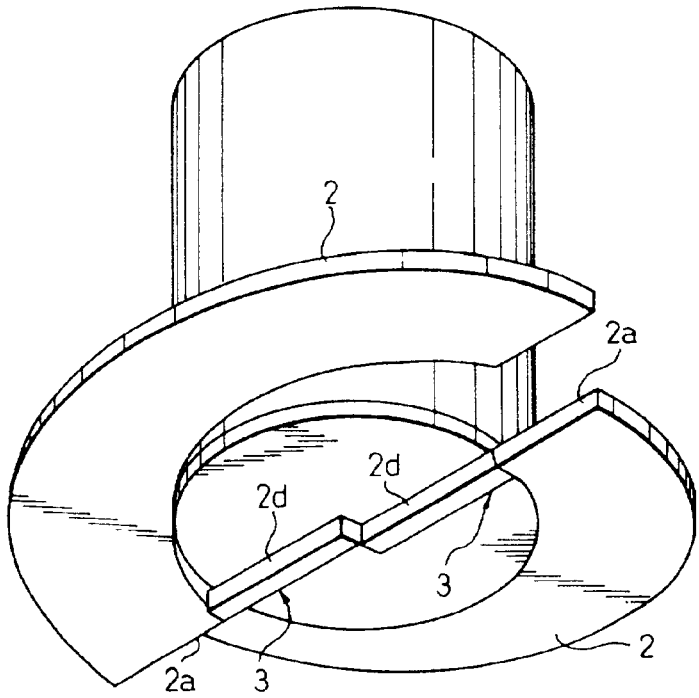

In the case of the pile shown in FIG. 18(*a*), the end portion of which is closed, and also in the case when the soil and sand in the pipe is blocked in the pile shown in FIG. 13, the end portion of which is open, projected area portion Ap is found by the following equation.

$$Ap=\pi(Do/2)^2$$

As a pre-stage of this construction management method for penetrating this screwed steel pile, the penetration mechanism of the screwed steel pile was made clear, by the present inventors, as follows.

When terminologies and marks are defined as follows, a relation between energy acting on the top portion of the pile and energy discharged from the bottom plate portion can be expressed by the relational drawing of FIG. 19.

A model of the dynamic state in which forces act on the top portion of the pile and the bottom plate portion is shown in FIG. 19.

LtS: Energy inputted into the top portion of the pile by an upper load

2πTt: Energy inputted into the top portion of the pile by torque acting on the top portion of the pile RpS: Energy consumed by the forward end portion when the bottom plate portion is penetrated αRpπDp': Energy discharged by friction between the bottom plate ring and the ground α(Rp−Lb)πDw': Energy discharged by friction between the wing and the ground c(Rp−Lb)(P−S): Energy consumed by the ground when the wing is forcibly deformed upward QwhπDw': Energy consumed by horizontal blade resistance QwvS: Energy consumed by vertical cutter resistance Intensities of the above energies are balanced as follows.

$$a(LtS+2\pi Tt)=LbS+2\pi Tb=RpS+\alpha Rp\pi Dp'+\alpha(Rp-Lb)\pi Dw'+c(Rp-Lb)(P-S)+Qwh\pi Dw'+QwvS \quad (11)$$

In this way, the following equation can be provided.

$$Rp=[2\pi Tb+Lb\{(1-c)S+cP+\alpha\pi Dw'\}-Qwh\pi Dw'-Qwvs]/\{(1-c)S+cP+\alpha\pi(Dp'+Dw')\} \quad (12)$$

As shown in equation (12), penetrative resistance Rp is calculated by: α estimated by the result of a boring test; diameter Dp' of an action circle, which is given as a design value, of the bottom plate or the bottom plate portion and diameter Dw' of an action circle of the wing; torque Tt measured and recorded in construction management, upper load Lt and penetration quantity S. Coefficient c, which is determined when the wing is forcibly deformed upward, is obtained by a relation between the physical values of the ground provided by a boring test and the penetration quantity. These parameters shown in equation (2) can be measured on the ground at any time before construction or in the process of construction. Therefore, it is possible to measure the penetrative resistance of all piles which have been executed. Accordingly, the quality of the foundation pile can be highly reliably guaranteed.

The forward end bearing capacity Qu of the pile can be found by the following equation.

$$Qu=(Rp/d)\times\{1+e(Aw/Ap)\} \quad (13)$$

As shown in equation (13), forward end bearing capacity Qu for supporting the forward end portion of the pile is calculated by: coefficient α, x, projected area Aw of only the wing which is determined by a configuration, projected area Ap of the bottom plate portion or the bottom plate ring, diameter Dp' of the action circle of the bottom plate or the bottom plate portion, and diameter Dw' of the action circle of the wing; and torque Tt measured as a recording item of construction management, upper load Lt, and penetration quantity S. These parameters can be measured on the ground at any time before construction or in the process of construction. Therefore, it is possible to measure the penetrative resistance of all piles which have been penetrated. Accordingly, the quality of the foundation pile can be highly reliably guaranteed. Ratio of blockage g of the bottom plate portion is given by the blocking effect of the pile, the end portion of which is open. Originally, ratio of blockage g of the bottom plate portion can be previously determined according to the inner diameter of the bottom plate ring and the quantity of soil of the bearing stratum which has entered the pipe. Rp estimated by the method of the present invention is evaluated as penetrative resistance in which the effect of this ratio of blockage is considered. Coefficients of correction e and d are given according to the circumstances at the stoppage of pile driving, especially, according to the final penetration quantity. The changing range is $0<e\leqq 1$ and $0<d\leqq 1$. Accordingly, forward end bearing capacity Qu for supporting the forward end portion of the pile can be estimated by the construction record.

The pulling capacity Qup of a pile end with respect to pulling is found by the following expression.

$$Qup\geqq Rp-Lb \quad (14)$$

As shown by the above expression (14), pulling capacity Qup of a pile end with respect to pulling is calculated by: coefficient α, and projected area Aw of only the wing which is determined by a configuration, projected area Ap of the bottom plate portion or the bottom plate ring, diameter Dp' of the action circle of the bottom plate or the bottom plate portion, and diameter Dw' of the action circle of the blade; and torque Tt measured as a recording item of construction management, upper load Lt, and penetration quantity S. These parameters can be measured on the ground at any time before construction or in the process of construction. Therefore, it is possible to measure the penetrative resistance of all piles which have been penetrated. Accordingly, quality of the foundation pile can be highly reliably guaranteed.

Figure 21:
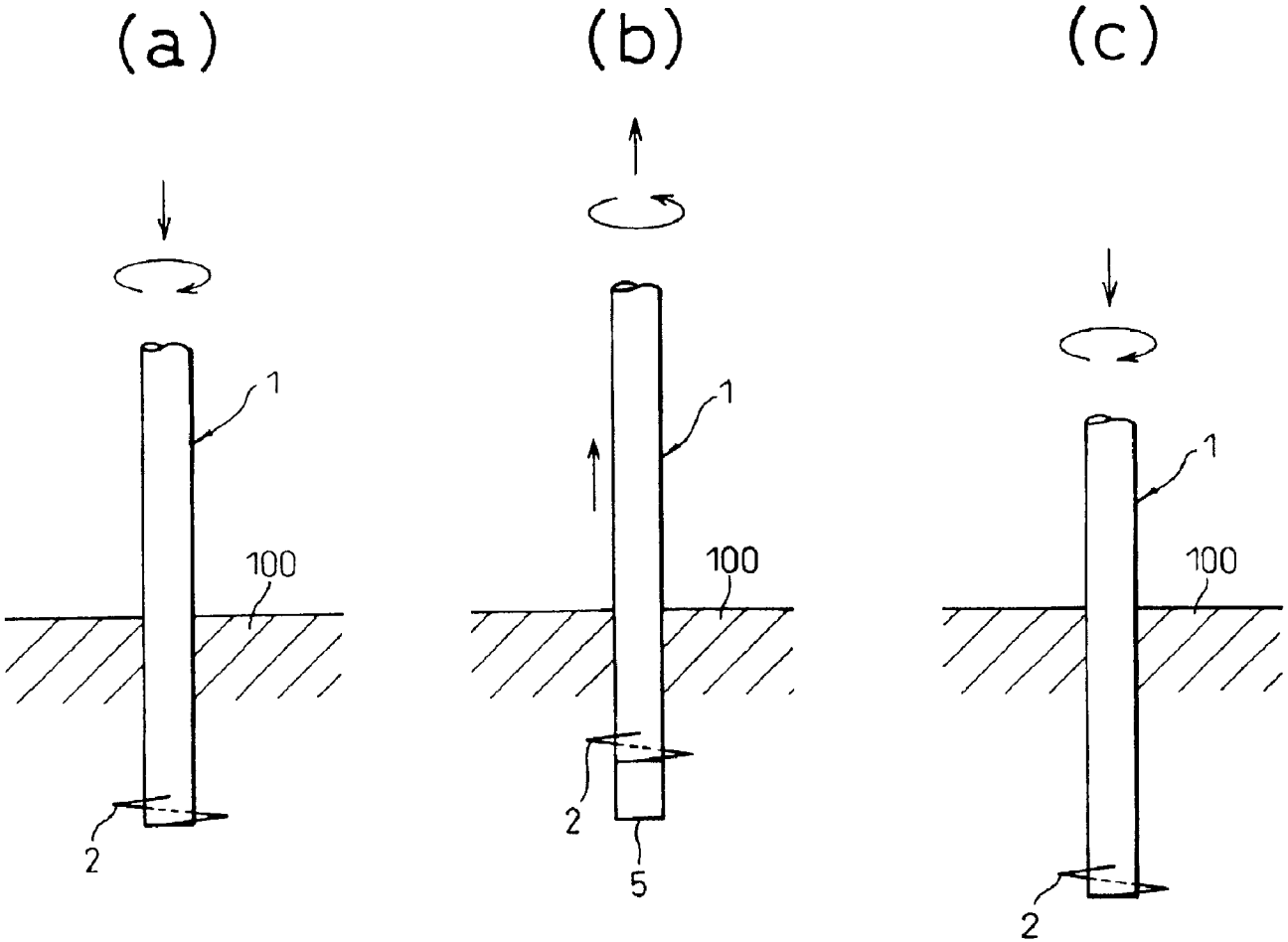
FIG. 21 is an operation procedure view showing an operation procedure of the embodiment of the present invention.
Figure 22:
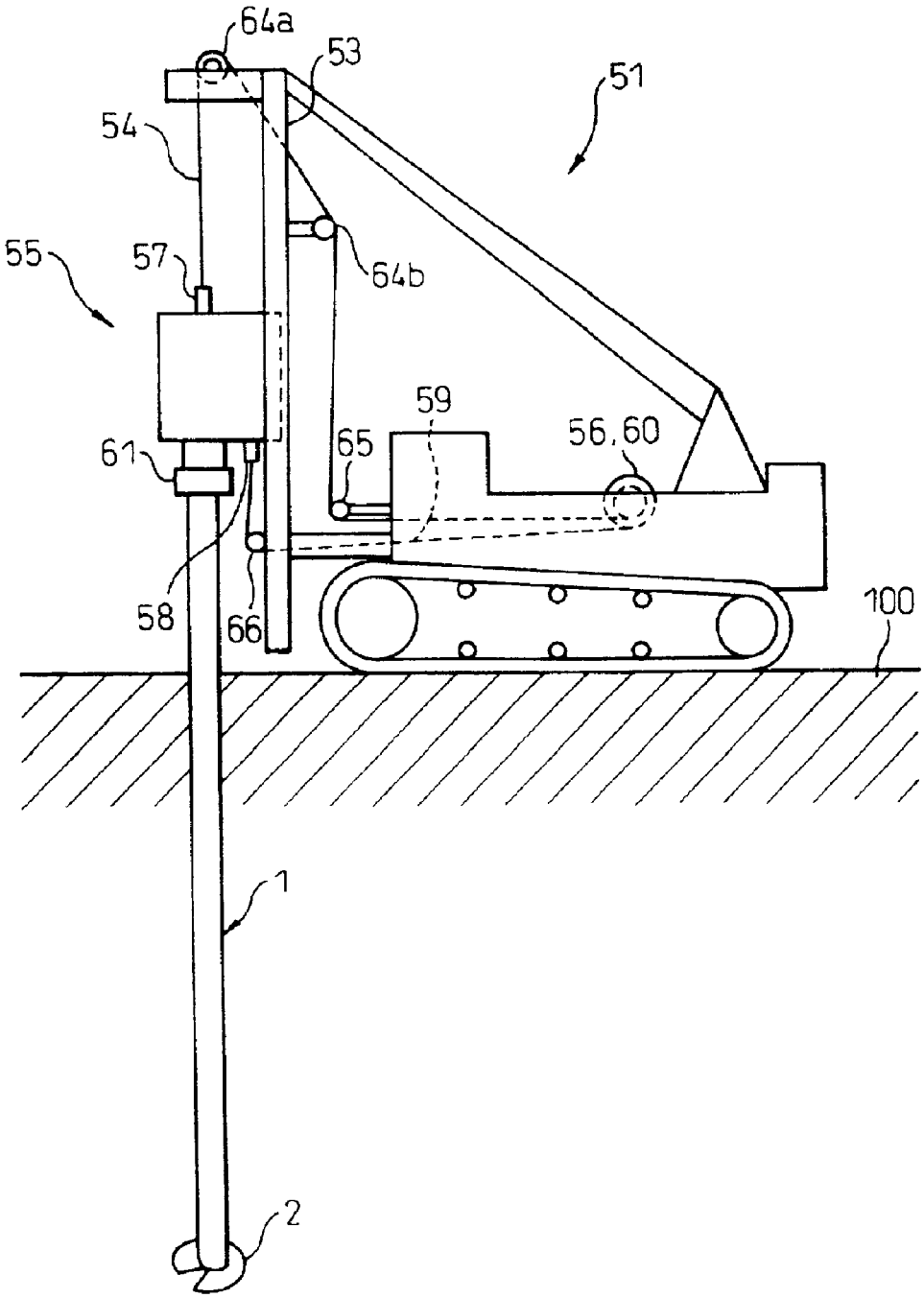
FIG. 22 is an arrangement view showing an outline of the overall arrangement of the excavating device of the embodiment of the present invention.

FIGS. 21(*a*), 21(*b*) and 21(*c*) are operation procedure views showing an operation procedure of the embodiment of the present invention. FIG. 22 is an arrangement view showing an outline of the overall arrangement of the screwed pile construction device of the embodiment of the present invention. Table 1 shows results of the experiment in which the screwed pile construction device shown in FIG. 22 was used and piles were penetrated into the ground while they were being rotated by the device. Table 1 is a construction record showing an example in which the penetration efficiency was lowered and then it was enhanced.

FIG. 22 is a view showing a screwed pile construction device 51 for penetrating a pile. The vertical leader (vertical guide member) 53 is vertically held at the front portion of the caterpillar vehicle 52. A lower portion of the hanging weight measurement device 57 composed of a load cell is fixed to an upper end portion of the auger drive unit (earth auger) 55. One end portion of the auger side wire rope (wire rope for hanging) 54 is connected with an upper portion of the hanging weight measurement device 57. The auger side wire ripe 54 is trained round the pulleys 64*a*, 64*b* respectively attached to the support arm fixed to an upper portion of the leader 53 and the intermediate portion of the leader 53, and also the auger side wire ripe 54 is trained round the pulley 65 attached to the main body of the caterpillar vehicle 52. After that, the auger side wire rope 54 is wound round the winding drum 56.

The auger screw 73 is arranged along a guide groove (not shown in the drawing) of the leader 53 in such a manner that the auger screw 73 can be freely elevated upward and downward. The displacing load measurement device 58 composed of a load cell is attached to a lower portion of the auger 55. One end of the displacing wire rope (wire rope for displace) is connected to a lower portion of the displacing load measurement device 58, and the displacing wire rope 59 is trained round the pulley 66 attached to a lower portion of the leader 53 and wound round the winding drum 60. The winding drums 56, 60 are respectively arranged at positions shifted from each other in the longitudinal direction. These winding drums 56, 60 are independently and separately driven by drive units (not shown in the drawing) so that they can be rotated normally or in reverse.

When the displacing wire rope 59 is wound by the winding drum 60 driven by the drive unit, the auger 55 is given a downward load by the displacing wire rope 59. Therefore, the pile and the wing 2 attached to the forward end portion of the pile are given a displacing load via the auger 55 and the chuck attached to the auger 55.

In this connection, the steel pipe pile 1 is hung and held by the chuck 61 arranged at a lower end portion of the auger 55. At a lower end portion of the steel pipe pile 1, the spiral wing 2 is provided.

In FIGS. 21 and 22, the diameter of the steel pipe pile 1 is 609.6 mm, the diameter of the wing is 914.4 mm, and the wing pitch is 214 mm. Under the above construction condition, the excavating experiment was made. The results of the experiment are shown on Table 1.

TABLE 1

Table of Construction Record
Pile diameter: 609.6 (mm), Wing diameter: 914.4 (mm), Wing pitch: 214 (mm)

| Depth (m) | Excavation torque (t-m) | Quantity of excavation (mm/revolution) | Upper load (t) Drawing force | Upper load (t) Displacing force | Upper load (t) Resultant force (downward) | Remark |
|---|---|---|---|---|---|---|
| 0.5 | 1.0 | 231 | 15 | 23 | 8 | |
| 1.0 | 1.0 | 309 | 9 | 34 | 25 | |
| 1.5 | 6.6 | 309 | 7 | 41 | 34 | |
| 2.0 | 7.5 | 185 | 5 | 41 | 36 | |
| 2.5 | 9.2 | 239 | 3 | 26 | 23 | |
| 3.0 | 3.0 | 143 | 3 | 19 | 16 | |
| 3.5 | 3.9 | 154 | 5 | 16 | 11 | |
| 4.0 | 1.0 | 178 | 11 | 16 | 5 | |
| 4.5 | 2.0 | 178 | 12 | 16 | 4 | |
| 5.0 | 1.0 | 296 | 11 | 16 | 5 | |
| 5.5 | 2.0 | 289 | 8 | 16 | 8 | |
| 6.0 | 2.0 | 262 | 7 | 31 | 24 | |
| 6.5 | 9.2 | 114 | 17 | 41 | 24 | |
| 7.0 | 14.5 | 113 | 10 | 36 | 26 | |
| 7.5 | 16.6 | 79 | 15 | 51 | 36 | |
| 8.0 | 15.9 | 26 | 5 | 56 | 51 | |
| 8.5 | 9.2 | 21 | 3 | 41 | 38 | |
| 8.9 | 3.0 | 9 | 1 | 51 | 50 | |
| 8.4 | 1.0 | −167 | 50 | 17 | −33 | Inverted at 8.9 m and lifted by 0.5 m |
| 8.5 | 1.0 | 84 | 5 | 40 | 35 | |
| 9.0 | 6.6 | 207 | 1 | 62 | 61 | |
| 9.5 | 2.0 | 107 | 8 | 51 | 43 | |
| 10.0 | 2.0 | 149 | 10 | 36 | 26 | |
| 10.5 | 1.0 | 135 | 10 | 36 | 26 | |
| 11.0 | 1.0 | 139 | 1 | 61 | 60 | |
| 11.5 | 11.6 | 151 | 5 | 61 | 56 | |
| 12.0 | 10.0 | 143 | 2 | 59 | 57 | |
| 12.5 | 19.8 | 83 | 2 | 46 | 44 | |
| 13.0 | 24.9 | 69 | 8 | 56 | 48 | Displacing was completed at 13 m. |

Upper load (t)

On the drawing side:

Tension of the wire rope on the auger side

On the press-fitting side:

Tension of the wire rope on the displacing side+Self-weight of the auger

On Table 1, each value represents an average value obtained when the pile is penetrated into the ground from the depth shown in the upper column to the depth shown in the lower column. At the depth 8.9 m, the pile was lifted by 0.5 m while it was being reversed. On Table 1, on the drawing side, the upper load (t) is a wire rope tension on the auger side, and on the displacing side, the upper load (t) is a value obtained when the self-weight of the auger is added to the wire rope tension for displacing. The downward resultant force is a value obtained when the upper load (t) on the drawing side is subtracted from the upper load (t) on the displacing side.

Referring to Table 1, the states shown in FIGS. 21(*a*), 21(*b*) and 21(*c*) respectively represent the following states.

(i) While the screwed pile composed of a steel pipe is being rotated and driven, it is penetrated into the ground 100, the depth of which is 8 to 9 m.

(ii) At the depth 8.5 m, a quantity of penetration becomes 9.0 mm, that is, the pile is almost idly rotated.

At the pile depth 8.9 m, the pile 1 is reversed and lifted by 0.5 m (shown in FIG. 21(*b*)).

(iii) While the pile head of the pile 1 is given a downward load by winding the wire rope 59 on the displacing side round the winding drum 60, the steel pipe pile 1 is rotated and thrust into the ground. At the depth 9.0 m, the upper load becomes 61 t (ton) and the quantity of penetration becomes 207 mm, that is, the pile is relatively intensely penetrated, so that the problem of the idling state can be solved, and the pile can be smoothly penetrated into the ground (shown in FIG. 21(*c*).

The reasons are described as follows.

When no thrust is generated by the wing 2 at the forward end portion of the pile and the steel pipe pile is idly rotated, the steel pipe pile 1 is reversed and returned by an appropriate distance. Due to the foregoing, the soil and sand 101 located at the lower portion of the pile shown in FIG. 23 can be released from the consolidation state, and the soil and sand 102 located on an upper face of the wing is forcibly dropped down, so that a gap 69 on a lower face of the wing can be filled with soil and sand.

Figure 23:
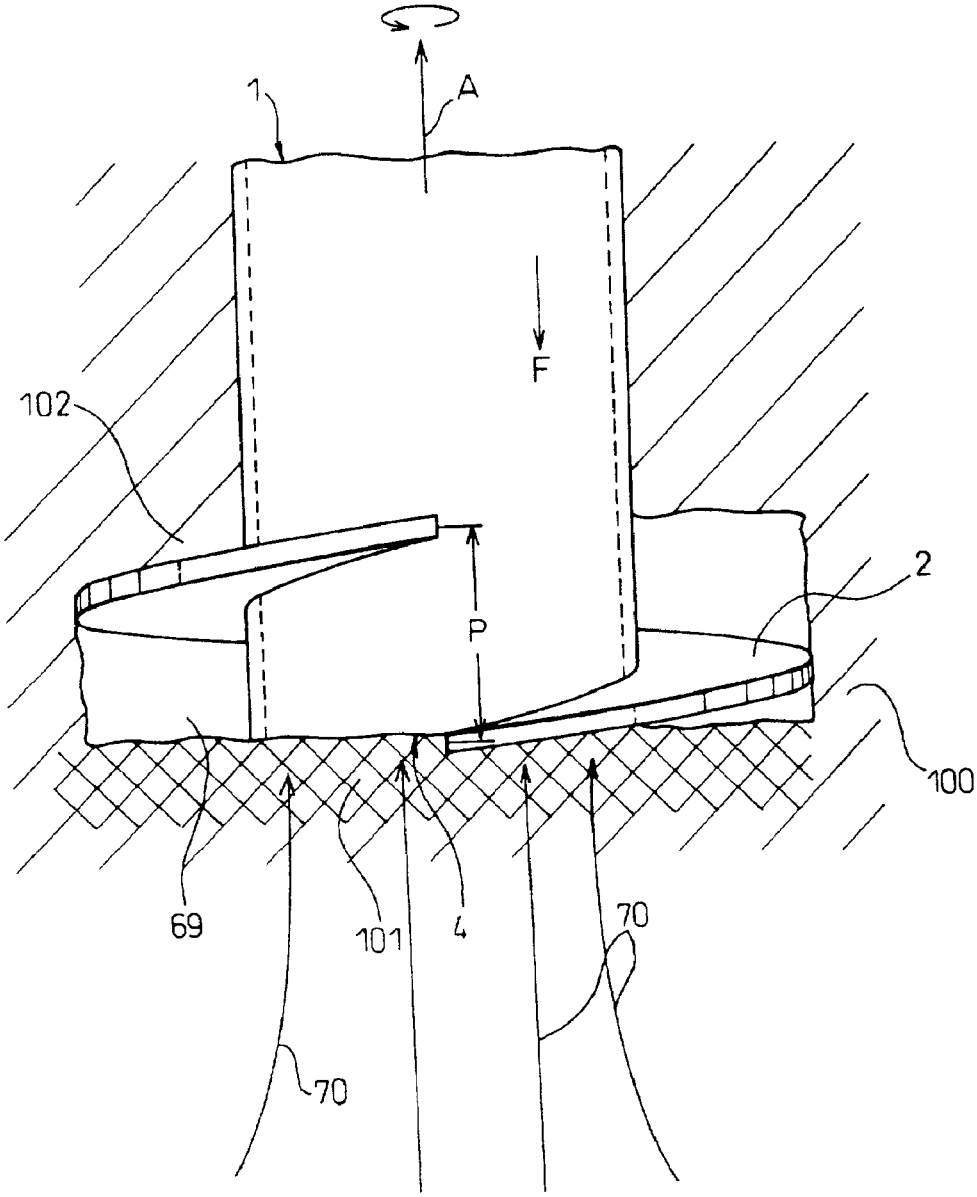
FIG. 23 is a schematic illustration showing a relation between the pile having a wing and the ground in the case where a lower end portion of the pile is idly rotated.

When the pile 1 is returned (drawn) by an appropriate distance in the direction of arrow A shown in FIG. 23, pressure in the gap becomes more negative than that in the peripheral ground 100. Therefore, pressure of the ground water is lowered. Therefore, an upward infiltration flow 70 is generated from the lower ground, so that strength of the ground of the forward end portion of the pile can be lowered. In other words, the wing can bite into the ground more deeply. In this way, it becomes possible to form a relatively weak ground. After the aforementioned ground has been formed, the pile is rotated and thrust again while a load is being given to the pile head. Due to the foregoing, an intensity of energy for thrusting the pile can be increased to a value higher than the ground resistance. Therefore, the pile can be penetrated into the ground which has been improved, so that intrusion of the pile can be easily made.

As described above, when the steel pipe pile is reversed a little and returned back upward, it becomes possible to solve the problem of idling of the pile, and the pile can be normally thrust into the ground. Therefore, the penetration efficiency can be enhanced and the period of construction work can be shortened, and further the construction cost can be reduced.

In this connection, in the case where a long screwed steel pipe pile is rotated and penetrated into the ground, when a penetration quantity is remarkably decreased at a plurality of depth levels, the present invention may be appropriately applied.

In the above embodiment, the present invention is applied to a screwed steel pipe pile, the lower end of which is open. However, it is possible to apply the present invention to a screwed steel pipe pile, the lower end of which is closed.

Figure 24:
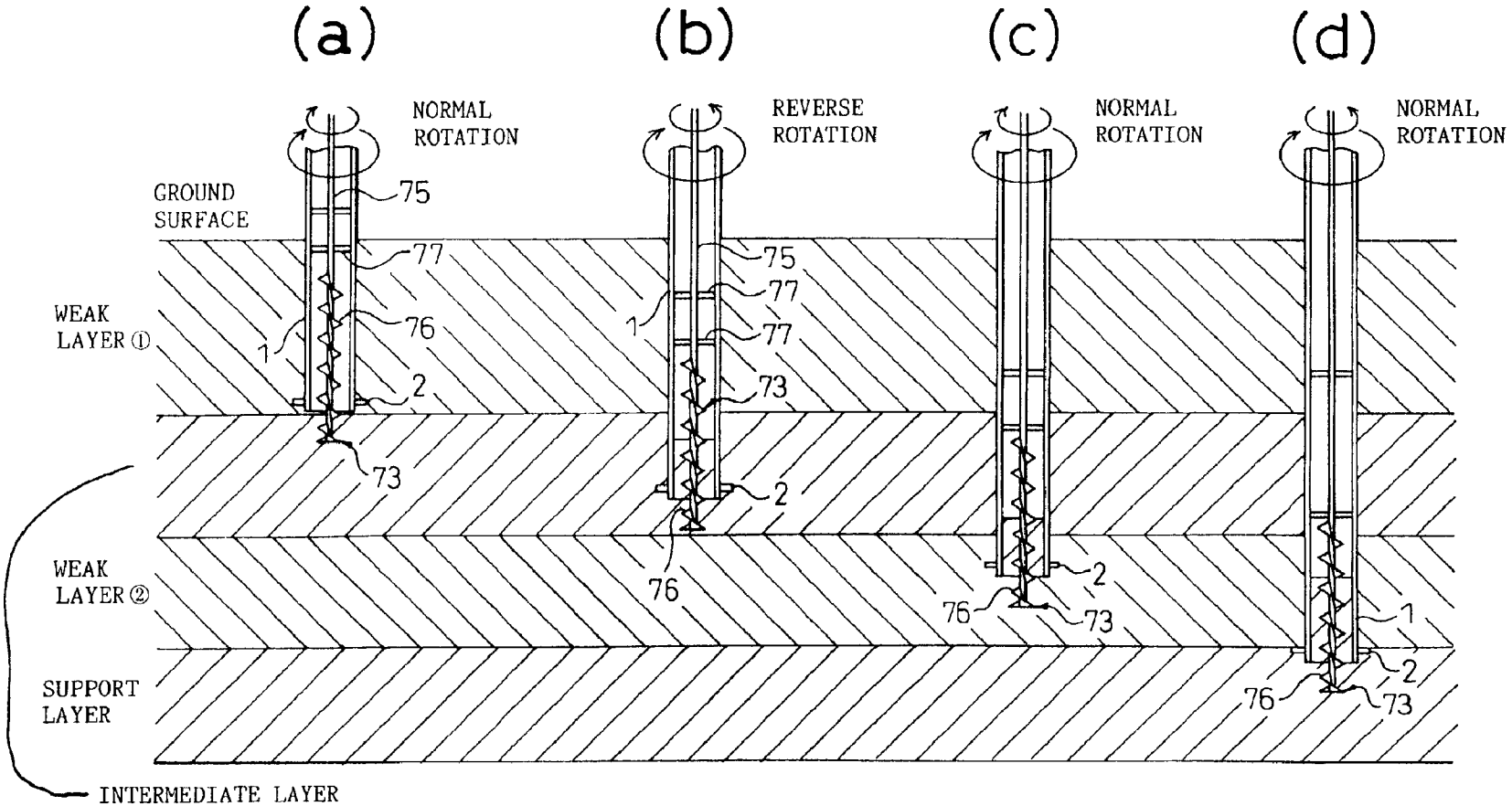
FIG. 24 is a view showing a pipe pile excavating device of the embodiment of the present invention and also

FIG. 24 is a view showing a pipe pile penetration device of the embodiment of the present invention and also showing a procedure of construction.

Figure 25:
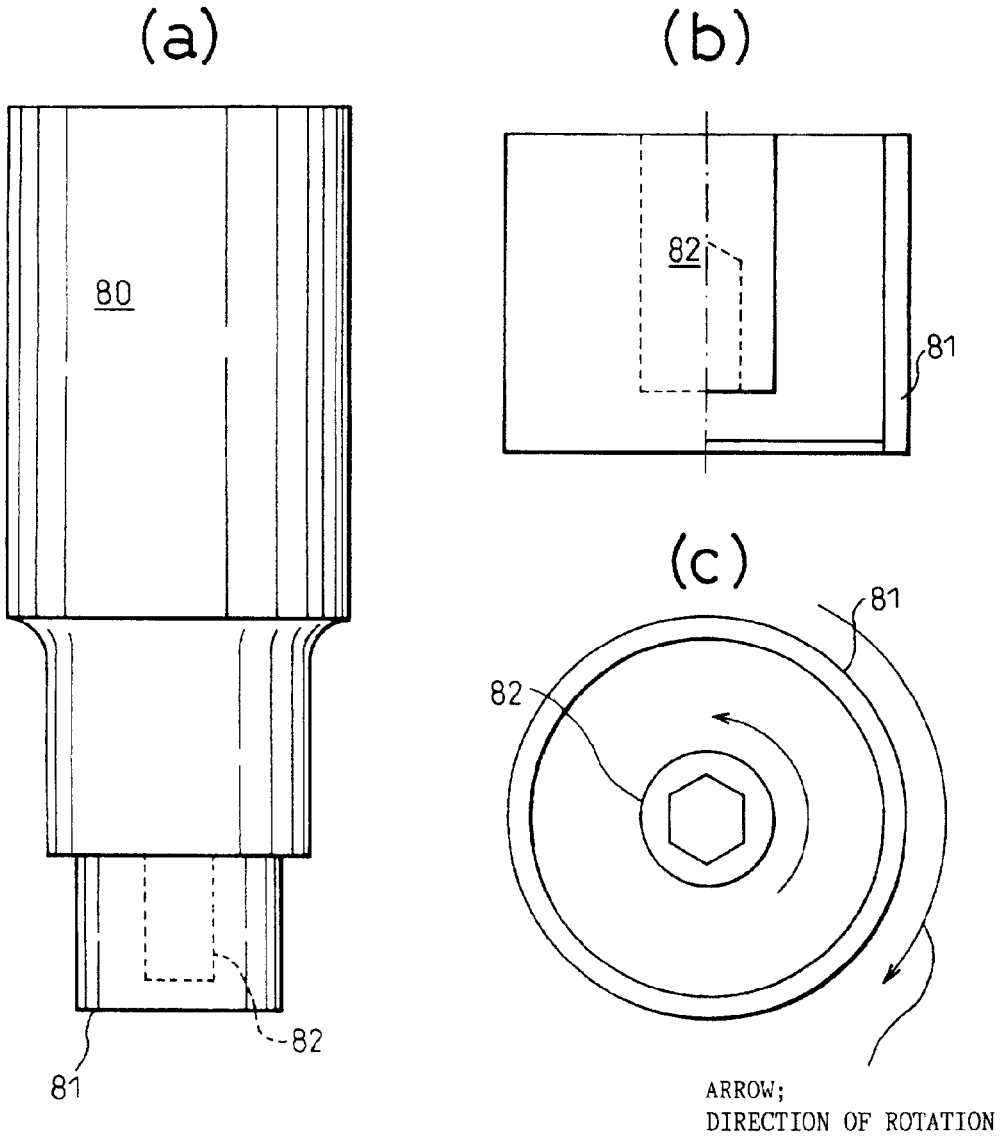
FIG. 25 is a view showing the details of a drive unit for driving a pipe pile and an auger at the top of the pipe pile excavation device shown in FIG. 24.

The pipe pile penetration device 51 as shown in FIG. 22 includes: a screwed pile 1; an auger screw 73; and a double doughnut type auger machine 55 (motor) shown in FIG. 22 and FIG. 25 for driving the pile 1 and the auger screw 73 respectively. The auger machine 55 includes: a pile drive section 81 for rotating the pile 1; and an auger drive section 82 for rotating the auger 73 normally and reversely.

The pile 1 is provided with a drilling wing 2 for drilling the ground, and this drilling wing 2 is arranged at a lower portion outside the pile body 1. The auger screw 73 is composed in such a manner that a spiral wing 76 for inside-drilling is attached to a lower portion of the auger shaft 75 inserted into the pile 1. The direction of the spiral of the spiral wing 76 is reverse to that of the spiral of the drilling wing 2.

At positions on the auger shaft 75, which are located at appropriate upper positions of the spiral wing 76, there are provided stabilizers 77, the number of which is appropriately determined, for holding the auger screw 73 perpendicularly.

Referring to FIGS. 24(*a*), 24(*b*), 24(*c*) and 24(*d*), the procedure of execution will be explained below.

In the drawings, the big rotary arrow represents a rotary direction of the screwed steel pile 1, and the small rotary arrow represents a rotary direction of the auger screw 73.

At first, the pile 1 is penetrated into the soft stratum (1) when the pile 1 is rotated normally, that is, drilling is conducted, and the auger screw 73 is rotated normally, that is, excavation is not conducted by the auger screw 73. Alternatively, the auger screw 73 may be stopped.

Soil and sand drilled by the wing 2 is forcibly discharged to the periphery of the pile 1, and the soft stratum (1) is consolidated and tightened and further water is discharged. In this way, the ground can be improved and the bearing capacity of the pile 1 can be increased. At this time, the wing 2 is rotated reversely to the direction of the spiral of the auger 55. Therefore, soil and sand is pushed back by the auger screw 73. Accordingly, soil and sand does not get into the pile 1 (shown in FIG. 24(*a*)).

When the pile 1 reaches an intermediate stratum which is a thin and hard stratum, the pile 1 is rotated for drilling as it is, that is, the pile is normally rotated, and the auger screw 73 is rotated for drilling, that is, the auger screw 73 is reversely rotated. Soil and sand, which has been drilled, is positively introduced into the pipe pile 2 by the auger screw 73. Due to the foregoing, penetrative resistance is remarkably reduced, and the pile can be penetrated into the intermediate stratum at low torque in a short period of time (shown in FIG. 24(*b*)).

The pile is screwed penetrated into the soft stratum (2) after it has passed through the intermediate stratum when the pile 1 is rotated for penetrating, that is, when the pile 1 is normally rotated and also when the auger 73 is rotated normally, that is, when no drilling is conducted by the auger. Alternatively, the auger 73 may be stopped.

Soil and sand drilled by the wing 2 is pushed back by the auger screw 73. Therefore, it is forcibly discharged to the periphery of the pile 1, and the soft stratum (2) is consolidated and tightened and further water is discharged. In this way, the ground can be improved and the bearing capacity of the pile 1 can be increased. At this time, the wing 2 is rotated reversely to the direction of the spiral of the auger 55. Therefore, soil and sand is pushed back by the auger screw 73. Accordingly, soil and sand does not get into the pile 1 (shown in FIG. 24(*c*)).

When the pile 1 reaches a bearing stratum, the pile 1 is rotated for drilling as it is, that is, the pile 1 is normally rotated, and the auger screw 73 is rotated for drilling, that is, the auger screw 73 is reversely rotated. In this way, drilling is conducted by the auger screw 73 and the wing 2, and the setting of the pile is conducted. Alternatively, drilling is conducted to a position where the excavating blade 2 gets into the bearing stratum.

After the setting of the pile has been completed or the wing 2 has entered the bearing stratum, while the auger screw 73 is being reversely rotated, it is lifted up and drawn out from the pile 1. When the auger screw 73 is lifted up while it is being normally rotated, it becomes possible to drop soil and sand into the pipe pile. Therefore, it becomes unnecessary to dispose of soil and sand. Of course, the auger screw 73 may be drawn out without being rotated.

Length of the spiral wing 6 of the auger screw 73 is five times as long as the inner diameter of the pile body at the maximum so that soil and sand cannot get out of the pipe pile head (shown in FIG. 24(*d*)).

According to the present invention, it is possible to adopt the following method. In the inside-drilling method, when the screwed steel pile is penetrated into the bearing stratum, drilled soil and sand is made to get into the screwed pile, and at the same time, solidifying material such as mortar and cement is jetted out from an end of the auger, so that the jetted solidifying material is solidified being integrated with the forward end portion of the screwed pile, and the pile is set and fixed on the bearing stratum. This inside-drilling method is carried out so that a bearing capacity of the screwed pile can be increased. For example, it is possible to adopt this method in which the ground in the periphery of the screwed pile forward end portion is drilled, and this portion is substituted by mortar. Also, it is possible to adopt a method in which mortar is displaced at high pressure, so that strength of the ground in the periphery of the screwed pile end portion can be enhanced and the bearing capacity of the screwed pile forward end portion can be increased. Also, it is possible to adopt a method in which the ground is drilled to a size a little larger than the screwed pile, and cement milk is filled between the ground and the screwed pile so as to increase a frictional force on the circumferential face. That is, an arbitrary method can be adopted in the present invention. When the above methods are adopted, it is unnecessary to provide a large excavating area, and it is possible to obtain a desired intensity of bearing capacity. Therefore, the construction efficiency can be further enhanced. In this connection, when the above inside-drilling method is adopted, it is possible to apply the construction management method defined by the present invention. In this case, when only the coefficient of correction is changed, the construction management method defined by the present invention can be applied.

Figure 26:
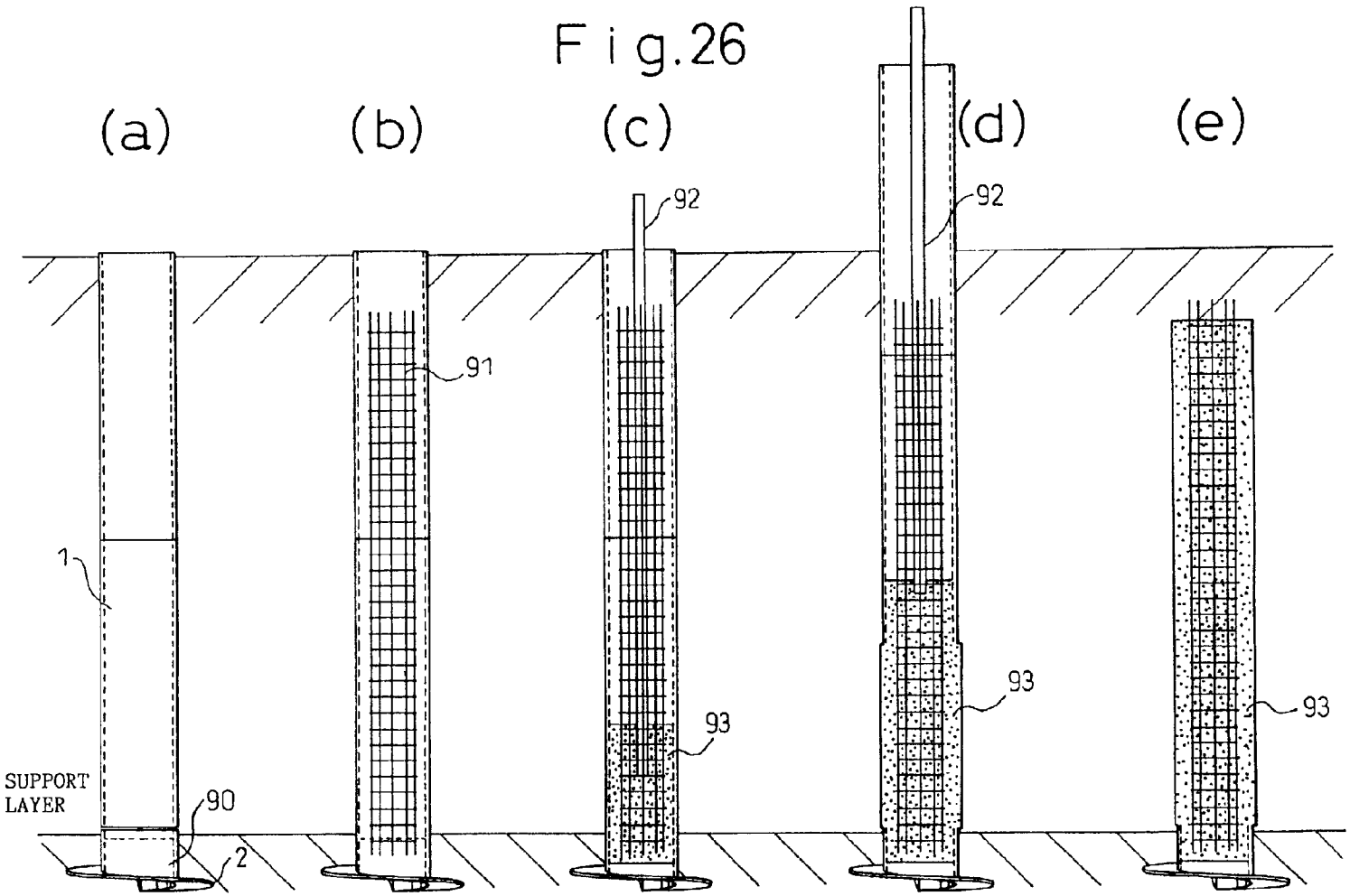
FIG. 26 is a view showing an construction process of the cast-in-place method in which the screwed steel pile of the present invention is used.

The screwed steel pile construction method of the present invention can be applied to a cast-in-place pile method in which concrete is cast after a pile has been driven, so that a reinforced concrete can be buried. This construction method is illustrated in FIGS. 26(*a*) to 26(*e*). In this construction method, the forward end portion 90 of a short steel pipe having a spiral wing is engaged with a forward end of the screwed steel pile 1, and rotation is given to the pile body 1 so that the pile can be buried in the ground. Next, after it has been confirmed that a predetermined intensity of torque can be obtained, the aforementioned forward end portion 90 is separated from the screwed steel pile 1, and only the thus separated forward end portion 90 is left on the bearing stratum. In this connection, it is preferable that penetration has been accomplished on the bearing stratum by 1Dw which is a diameter of the wing. Even if penetration has not been accomplished, it is possible to make sure of penetration by conducting torque management. After this work has been completed, the reinforcing bar cage 91 is inserted and set in the pile 1. Then the tremie tube 92 is inserted into the pile 1 and lowered to the forward end portion, and concrete is cast from an end of the tremie tube 92. At the same time, the screwed steel pile 1 and the tremie tube 92 are gradually lifted up, and concrete is cast at the upper portion. In this way, construction work is completed.

In this connection, concerning the mechanism for disengaging the forward end portion 90 of the steel pile having the spiral wing from the screwed steel pile 1, various methods are provided. However, it is sufficient to adopt a common method in which a top-shaped or a chuck-shaped engaging portion is provided and engagement is released by reversing the engaging portion.

Embodiments

Embodiments to which the above equations are applied to an actual construction site will be explained below.

Embodiment 1

There is shown an embodiment in which a steel pipe pile, the diameter of which was 406.4 mmϕ, was controlled for construction so that penetration could be continued and completed while penetrative resistance was being found.

Other conditions of construction of this steel pipe pile are described below. Diameter Dp' of the action circle of the bottom plate was 270.9 mm, diameter Dw' of the action circle of the wing was 514.8 mm, angle θ of the wing with respect to a face perpendicular to the pile axis was 5°, and designed penetrative resistance was previously calculated to be 97.0 t.

Figure 14:
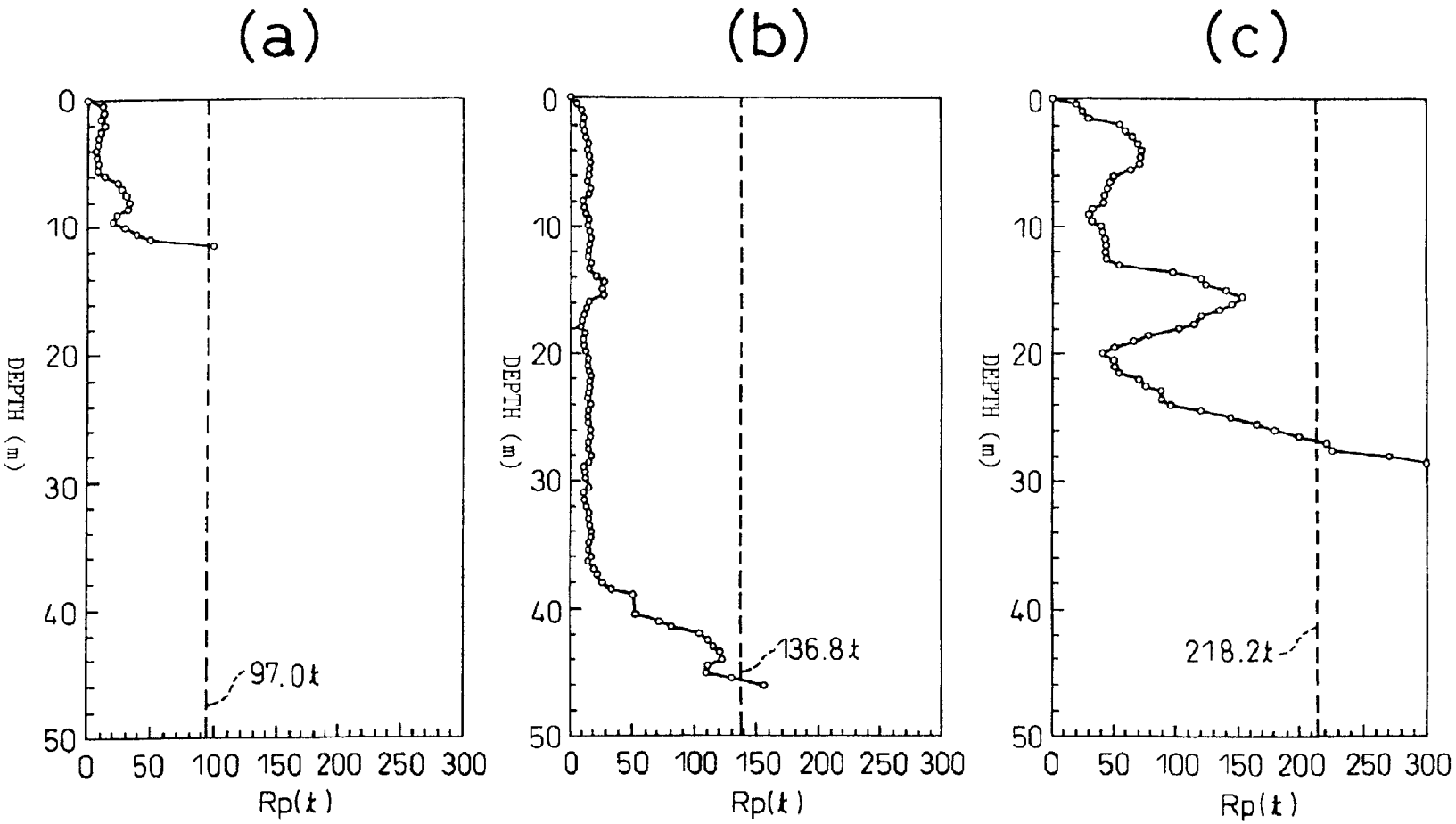
FIG. 14(*a*) is a graph showing a result of the measurement of a change in the penetrative resistance in the first embodiment of the present invention.

In construction, coefficient α of friction between the ground and a steel plate was 0.3, coefficient γ of resistance of the perpendicular cutter was 0.03, ratio "a" of transfer of upper load Lt and torque Tt to the forward end of the pile was 0.9, and horizontal blade resistance Qwh was neglected because it was very low. Under the above conditions, changes in penetrative resistance were measured. The results of measurement are shown in FIG. 14(*a*). Since penetrative resistance was lower than the designed penetrative resistance until the pile reached the depth 11.5 m, penetration of the pile was continued. At the depth 11.5 m, the upper load acting on the pile head was 13 t, and torque Tt acting on the pile head was 14.5 tm, and quantity of penetration S was 10.5 cm. Penetrative resistance Rp was calculated by equation (8) as follows.

$$Rp=97.5\ (t)$$

That is, penetrative resistance Rp was increased to a value higher than the designed penetrative resistance. Therefore, penetration was completed.

In this case, bearing capacity Qu of the pile forward end can be found as follows. In this case, projected area Aw of the wing of the steel pipe pile used here was 0.162 $m^2$, and projected area Ap of the bottom plate portion was 0.130 $m^2$. Effectiveness ratio e of the wing portion was 0.5. Coefficient "d" of correction determined by the quantity of penetration (S=10.5 cm) in the case of stopping the drive of the pile was 0.85. Therefore, bearing capacity Qu of the pile forward end was found by equation (9) as follows.

$$Qu=186.4\ (t)$$

In the case where-penetrative resistance Rp was 97.5 t, pulling capacity Qup of the pile forward end with respect to pulling was found as follows.

Ratio "a" of transfer of upper load Lt to the forward end of the pile was set at 0.9. Since upper load Lt was 13 t which was obtained in the process of construction, pulling capacity Qup of the pile forward end with respect to pulling was found by equation (10) as follows.

$$Qup \geqq 85.8\ (t)$$

Embodiment 2

There is shown an embodiment in which a steel pipe pile, the diameter of which was 508.0 mmϕ, was controlled for construction so that penetration could be continued and completed while penetrative resistance was being found.

Other conditions of construction of this steel pipe pile are described below. Diameter Dp' of the action circle of the bottom plate was 338.7 mm, diameter Dw' of the action circle of the wing was 790.2 mm, angle θ of the wing with respect to a face perpendicular to the pile axis was 5°, and designed penetrative resistance was previously calculated to be 136.8 t.

In construction, the coefficient α of friction between the ground and a steel plate was 0.3, the coefficient γ of resistance of the perpendicular cutter was 0.03, ratio "a" of transfer of upper load Lt and torque Tt to the forward end of the pile was 0.9, and the horizontal cutter resistance Qwh was neglected because it was very low. Under the above conditions, changes in penetrative resistance were measured. The results of measurement are shown in FIG. 14(*b*). Since penetrative resistance was lower than the designed penetrative resistance until the pile reached the depth 48.0 m, penetration of the pile was continued. At the depth 48.0 m, the upper load acting on the pile head was 14 t, and torque Tt acting on the pile head was 32.9 tm, and quantity of penetration S was 13.0 cm. Penetrative resistance Rp was calculated by equation (8) as follows.

$$Rp=148.5\ (t)$$

That is, penetrative resistance Rp was increased to a value higher than the designed penetrative resistance. Therefore, penetration was completed.

In this case, bearing capacity Qu of the pile forward end can be found as follows. In this case, projected area Aw of the wing of the steel pipe pile used here was 0.608 $m^2$, and projected area Ap of the bottom plate portion was 0.203 $m^2$. Effectiveness ratio e of the wing portion was 0.4. Coefficient "d" of correction determined by the quantity of penetration (S=13.0 cm) in the case of stopping the drive of the pile was 0.90. Therefore, bearing capacity Qu of the pile forward end was found by equation (9) as follows.

$$Qu=363.0\ (t)$$

In the case where penetrative resistance Rp was 148.5 t, pulling capacity Qup of the pile forward end with respect to pulling was found as follows.

Ratio "a" of transfer of upper load Lt to the forward end of the pile was set at 0.9. Since upper load Lt was 14 t which was obtained in the process of construction, pulling capacity force Qup of the pile forward end with respect to pulling was found by equation (10) as follows.

$$Qup \geqq 135.9 \text{ (t)}$$

Embodiment 3

There is shown an embodiment in which a steel pipe pile, the diameter of which was 609.6 mmϕ, was controlled for construction so that penetration could be continued and completed while penetrative resistance was being found.

Other conditions of construction of this steel pipe pile are described below. Diameter Dp' of the action circle of the bottom plate was 406.4 mm, diameter Dw' of the action circle of the wing was 772.2 mm, angle θ of the wing with respect to a face perpendicular to the pile axis was 5°, and designed penetrative resistance was previously calculated to be 218.2 t.

In construction, the coefficient α of friction between the ground and a steel plate was 0.3, coefficient γ of resistance of the perpendicular cutter was 0.03, ratio "a" of transfer of upper load Lt and torque Tt to the forward end of the pile was 0.9, and horizontal blade resistance Qwh was neglected because it was very low. Under the above conditions, changes in penetrative resistance were measured. The results of measurement are shown in FIG. 14(*c*). Since penetrative resistance was lower than the designed penetrative resistance until the pile reached the depth 29.0 m, penetration of the pile was continued. At the depth 29.0 m, the upper load acting on the pile head was 26 t, and torque Tt acting on the pile head was 85.0 tm, and quantity of penetration S was 18.0 cm. Intrusion resistance Rp was calculated by equation (8) as follows.

$$Rp=365.4 \text{ (t)}$$

That is, penetrative resistance Rp was increased to a value higher than the designed penetrative resistance. Therefore, penetration was completed.

In this case, bearing capacity Qu of the pile forward end can be found as follows. In this case, projected area Aw of the wing of the steel pipe pile used here was 0.365 $m^2$, and projected area Ap of the bottom plate portion was 0.292 $m^2$. Effectiveness ratio e of the wing portion was 0.5. Coefficient "d" of correction determined by the quantity of penetration (S=18.0 cm) in the case of stopping the drive of the pile was 0.95. Therefore, bearing capacity Qu of the pile forward end was found by equation (9) as follows.

$$Qu=625.0 \text{ (t)}$$

In the case where penetrative resistance Rp was 365.4 t, pulling capacity Qup of the pile forward end with respect to pulling was found as follows.

Ratio "a" of transfer of upper load Lt to the forward end of the pile was set at 0.9. Since upper load Lt was 26 t which was obtained in the process of construction, proof strength of a pulling capacity Qup of the pile forward end with respect to pulling was found by equation (10) as follows.

$$Qup \geqq 342.0 \text{ (t)}$$

Embodiment 4

Figure 15:
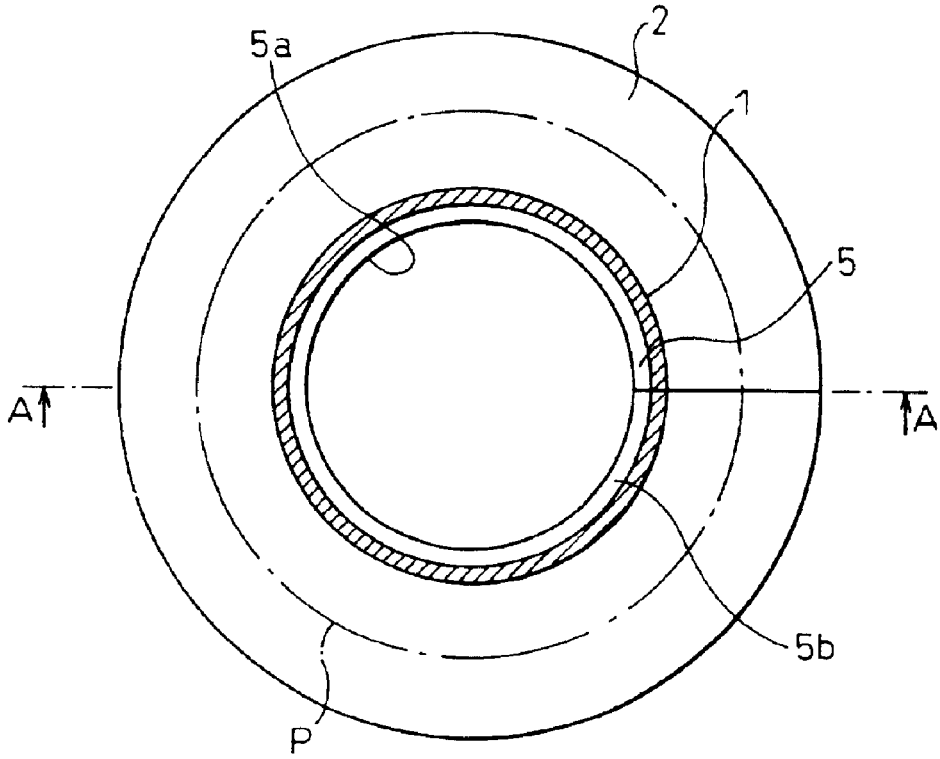
FIG. 15 is a plan view of the screwed steel pile shown in FIG. 16.

The fourth embodiment of the present invention shown in FIGS. 13, 15 and 16 relates to a pile, the end of which is open, wherein the bottom plate ring 5 is welded onto an end face of the pile body 1 composed of a steel pipe. Concerning the wing, one piece of one roll of a spiral wing is used and welded to the bottom plate ring 5 and the outside of the pile body 1. The protruding portion 2*a*, which is a lower end portion of the wing 2, protrudes from the lower face 5*c* of the bottom plate ring 5 by a distance corresponding to the thickness of the wing 2. The extending portion 2*d* is welded to the bottom plate ring 5 with respect to the entire width of the bottom plate ring 5 in the radial direction. The extending portion 2*d* composes a drilling bit together with the forward end portion 2*a* of the wing 2. In this case, the extending portion 2*d* and the forward end portion 2*a* of the blade 2 may be integrated with each other into one body, however, the extending portion 2*d* and the forward end portion 2*a* of the wing 2 may be composed being separate from each other.

Embodiment 5

Figure 17:
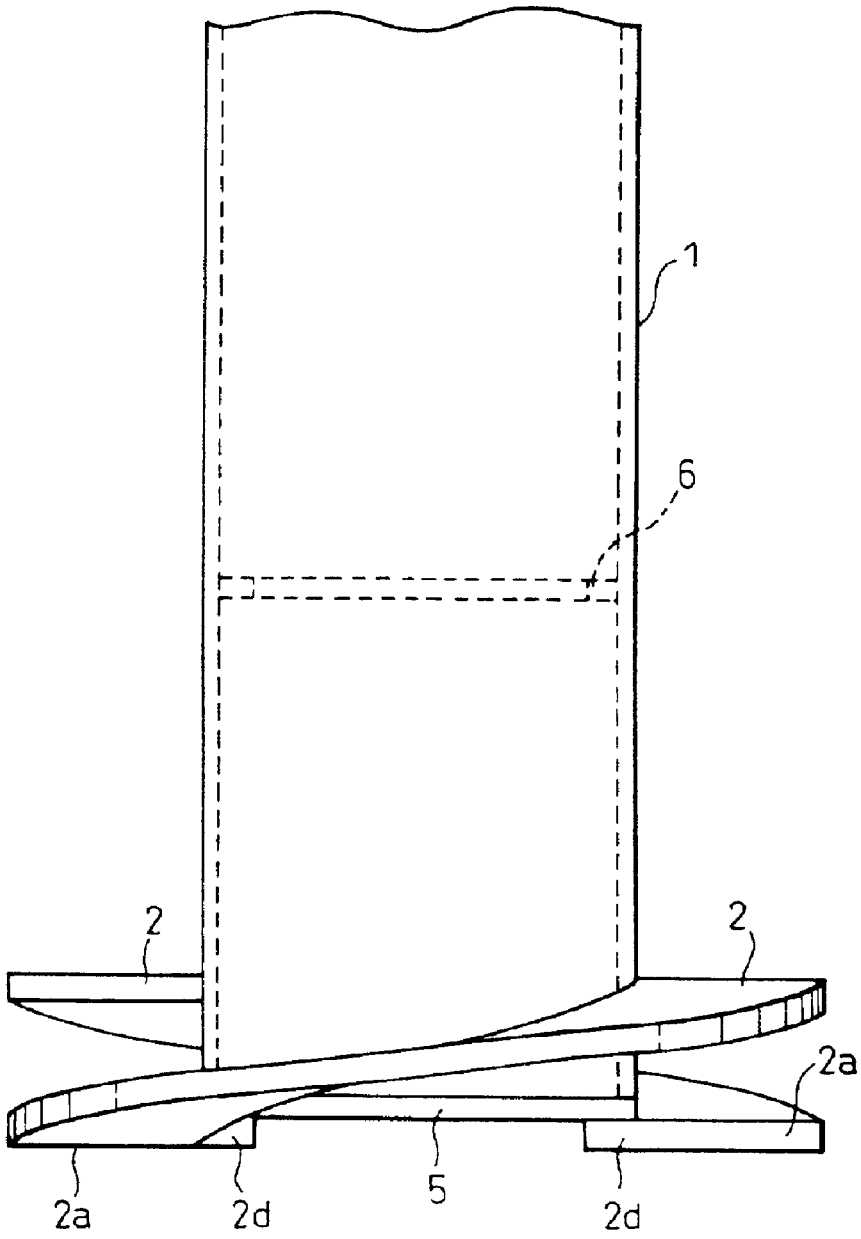
FIG. 17 is a front view of the screwed steel pile of the open end system of the fifth embodiment of the present invention, wherein two spiral wings are used in the pile.

The fifth embodiment of the present invention shown in FIG. 17 also relates to a pile, the end of which is open, wherein the bottom plate ring 5 is welded onto an end face of the pile body 1 composed of a steel pipe. Concerning the wing, two pieces of spiral wings, each spiral wing is a half roll, are used and welded to the bottom plate ring 5 and the outside of the pile body 1. The forward end portion 2*a*, which is a lower end portion of the wing 2, protrudes from the bottom plate ring 5 by a distance corresponding to the thickness of the wing 2. Each extending portion 2*d* is welded to the bottom plate ring 5 with respect to the entire width of the bottom plate ring 5 in the radial direction. The extending portion 2*d* composes a drilling bit together with the forward end portion 2*a* of the wing 2.

Embodiment 6

The sixth embodiment of the present invention shown in FIG. 18(*a*) relates to a pile, the end of which is closed, wherein the bottom plate 4 is welded onto an end face of the pile body 1 composed of a steel pipe. Concerning the wing, one piece of one roll of a spiral wing is used and welded to the bottom plate 4 and the outside of the pile body 1. The forward end portion 2*a*, which is a lower end portion of the wing 2, protrudes from the lower face of the bottom plate 4 by a distance corresponding to the thickness of the wing 2. The extending portion 2*d* is welded to the bottom plate 4 by a distance of the radius in the radial direction of the bottom plate 4. The extending portion 2*d* composes a excavating blade together with the forward end portion 2*a*of the wing 2. In this case, the extending portion 2*d* and the forward end portion 2*a* of the wing 2 may be integrated with each other into one body, however, the extending portion 2*d* and the forward end portion 2*a* of the wing 2 may be composed separate from each other.

Seventh Embodiment

In this embodiment, a steel pipe pile, the end of which was open, the diameter of which was 500 mm, was used. While the penetrative resistance of this steel pipe pile was being found, penetration of the pile was controlled so that penetration could be continued and completed according to the thus found penetrative resistance.

Other conditions of construction of this steel pipe pile are described below. Diameter Dp' of the action circle of the bottom plate was 333 mm, diameter Dw' of the action circle of the wing was 633 mm, and designed penetrative resistance was previously calculated to be 176.4 t.

Figure 20:
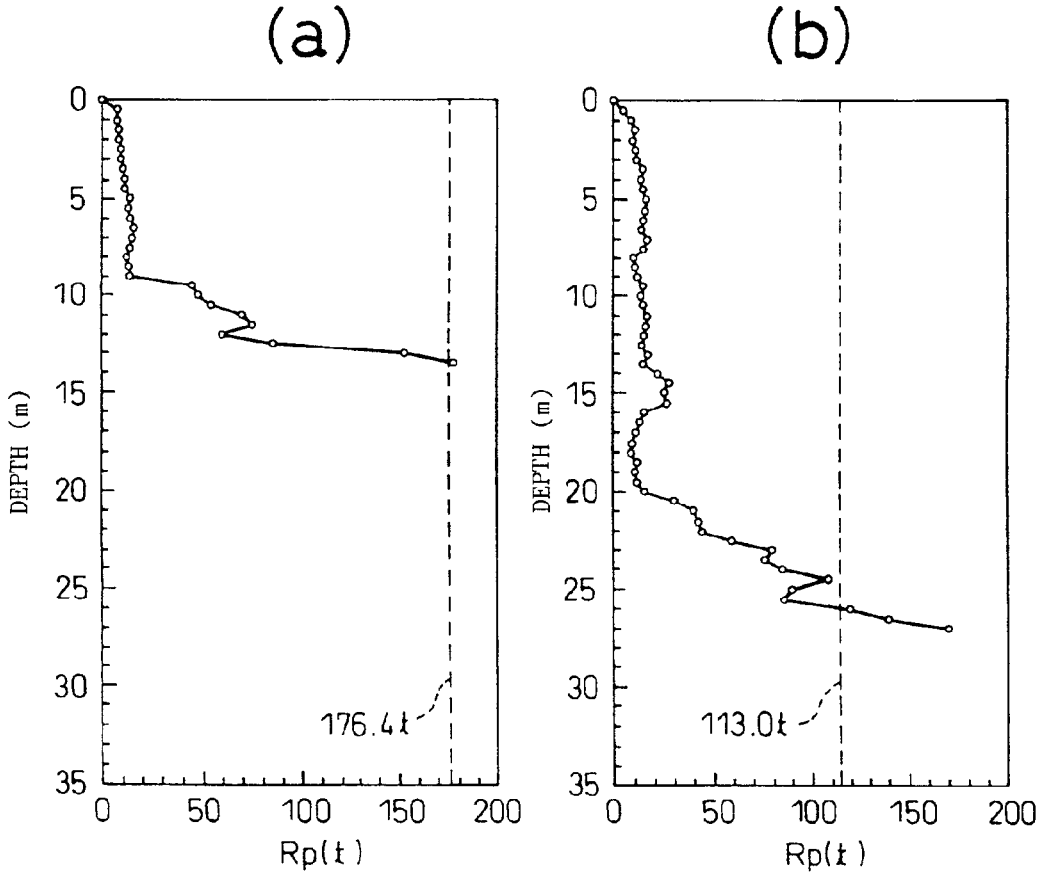
FIG. 20(*a*) is a graph showing a result of the measurement of a change in the penetrative resistance in the first embodiment of the present invention.

In construction, coefficient α of friction between the ground and a steel plate was 0.4, ratio "a" of transfer of upper load Lt and torque Tt to the forward end of the pile was 0.9, and horizontal blade resistance and vertical blade resistance were neglected because they were very low. Under the above conditions, changes in penetrative resistance were measured. The results of measurement are shown in FIG. 20(*a*). Since penetrative resistance was lower than the designed penetrative resistance until the pile reached the depth 13.5 m, penetration of the pile was continued. At the depth 13.5 m, the upper load acting on the pile head was 25.0 t, and torque Tt acting on the pile head was 40 tm, and a quantity of penetration S was 15 cm. Penetrative resistance Rp was calculated by equation (2) as follows.

$$Rp=178.5 \text{ (t)}$$

That is, penetrative resistance Rp was increased to a value higher than the designed penetrative resistance. Therefore, penetration was completed.

In this case, bearing capacity Qu of the pile forward end can be found as follows. In this case, projected area Aw of the wing of the steel pipe pile used here was 0.245 $m^2$, and projected area Ap of the bottom plate portion was 0.196 $m^2$. Effectiveness ratio e of the wing portion was 0.4. Coefficient "d" of correction determined by the quantity of penetration (S=15 cm) in the case of stopping the drive of the pile was 0.9. Therefore, bearing capacity Qu of the pile forward end was found by equation (13) as follows.

$$Qu=297.5\ (t)$$

In the case where penetrative resistance Rp was 178.5 t, proof strength of a pulling capacity Qup of the pile forward end with respect to pulling was found as follows.

Ratio "a" of transfer of upper load Lt to the forward end of the pile was set at 0.9. Since upper load Lt was 25.0 t in the process of construction, proof strength of a pulling capacity Qup of the pile forward end with respect to pulling was found by equation (14) as follows.

$$Qup \geqq 156.0\ (t)$$

Embodiment 8

Another embodiment described in claims 11 to 13 will be explained below.

In this embodiment, a steel pipe pile, the end of which was open, the diameter of which was 400 mm, was used. While penetrative resistance of this steel pipe pile was being found, drilling construction of the pile was controlled so that penetration could be continued and completed according to the thus found penetrative resistance.

Other conditions of construction of this steel pipe pile are described below. Diameter Dp' of the action circle of the bottom plate was 267 mm, diameter Dw' of the action circle of the wing was 622 mm, and designed penetrative resistance was previously calculated to be 113.0 t.

In construction, the coefficient $\alpha$ of friction between the ground and a steel plate was 0.4, ratio "a" of transfer of upper load Lt and torque Tt to the forward end of the pile was 0.85, and horizontal blade resistance and vertical blade resistance were neglected because they were very low. Under the above conditions, changes in penetrative resistance were measured. The results of measurement are shown in FIG. 20(*b*). Since penetrative resistance was lower than the designed penetrative resistance until the pile reached the depth 27.0 m, penetration of the pile was continued. At the depth 27.0 m, the upper load acting on the pile head was 15.0 t, and torque Tt acting on the pile head was 26.5 tm, and quantity of penetration S was 10 cm. Penetrative resistance Rp was calculated by equation (2) as follows.

$$Rp=119.0\ (t)$$

That is, penetrative resistance Rp was increased to a value higher than the designed penetrative resistance. Therefore, penetration was completed.

In this case, bearing capacity Qu of the pile forward end can be found as follows. In this case, projected area Aw of the wing of the steel pipe pile used here was 0.377 $m^2$, and projected area Ap of the bottom plate portion was 0.126 $m^2$. Effectiveness ratio e of the wing portion was 0.3. Coefficient "d" of correction determined by the quantity of penetration (S=10 cm) in the case of stopping the drive of the pile was 0.8. Therefore, bearing capacity Qu of the pile forward end was found by equation (13) as follows.

$$Qu=282.2\ (t)$$

In the case where penetrative resistance Rp was 119.0 t, pulling capacity Qup of the pile forward end with respect to pulling was found as follows.

Ratio "a" of transfer of upper load Lt to the forward end of the pile was set at 0.85. Since upper load Lt was 15.0 t in the process of construction, a pulling capacity Qup of the pile forward end with respect to pulling was found by equation (14) as follows.

$$Qup \geqq 106.2\ (t)$$

INDUSTRIAL APPLICABILITY

As described above, in the screwed steel pile according to the present invention, an end portion of the pile is open or closed, and one or a plurality of wings are arranged on the outside of the forward end portion of the pile body, and a excavating blade is attached to its forward end portion. Accordingly, when the strength of the ground is suddenly increased, the drilling force and thrust can be enhanced. As a result, the apparent resistance acting on the forward end portion is reduced, so that the pile can penetrate into the ground easily. When the pile is further penetrated into the ground, the blocking effect is facilitated, and penetrative resistance is increased. However, an intensity of thrust is increased at this time, and the pile can be sufficiently penetrated into the ground. Due to the foregoing, the efficiency of construction can be improved, and a sufficiently high intensity of bearing capacity can be provided by the forward end portion of the pile.

In the present invention, specific parameters are measured and recorded before the construction of a screwed steel pile or in the process of the construction of a screwed steel pile, and also only data capable of being measured on the ground is recorded in the process of construction. The thus measured results are substituted into the equations proposed by the present invention. In this way, penetrative resistance can be easily and positively calculated. Therefore, when the method of the present invention is adopted, it is possible to highly accurately guarantee the designed quality and performance of a foundation pile compared with the conventional method of constructing a foundation pile.

Further, it is possible to highly accurately measure a bearing capacity of the forward end portion of the pile and a pulling capacity of the forward end portion of the pile with respect to pulling the pile. Accordingly, it is possible to provide a foundation pile of high quality and performance.

What is claimed is:

1. A method of construction of a screwed steel pile, in which inside-drilling method is also used, comprising the step of: drilling, rotating and penetrating the screwed steel pile on a soft stratum of a ground and discharging drilled soil and sand to a periphery of the pile so that the drilled soil and sand cannot enter the pile; and conducting inside-drilling on a hard intermediate stratum or bearing stratum so that the drilled soil and sand can enter the pile.

2. A method of construction of a screwed steel pile according to claim 20, wherein drilled soil and sand are made to enter the screwed pile by the inside-drilling method when the screwed pile is penetrated into a bearing stratum, and solidification material such as cement mortar or cement milk is jetted out from an end of the auger so that the jetted solidification material is solidified and integrated with the forward end portion of the screwed pile, and the screwed pile is supported by and fixed to the bearing stratum of the ground.

3. A method of construction of a screwed steel pile comprising the steps of: inserting an auger used for inside-drilling having a spiral wing of an appropriate length into the screwed steel pile, the end of which is open, having a drilling wing outside of the pile end of the screwed steel pile body, from the lower side, the rotation of the auger being controlled separately from the rotation of the pile; drilling, rotating and penetrating the pile into a soft stratum of the ground so as to drill soil and sand by the drilling wing and forcibly discharge the drilled soil and sand to the periphery of the pile body, the rotation of the auger being stopped during penetrating the pile so that soil and sand cannot enter the pile; and drilling and rotating the auger on a hard stratum of the ground such as an intermediate stratum and a bearing stratum of the ground so that the drilled soil and sand can enter the pile.

4. A method of construction management for managing the construction of a screwed steel pile having one or a plurality of wings on the lower end portion of the pile, comprising the steps of: finding penetrative resistance Rp by the following equation in the process of construction; and controlling to continue and/or complete penetration of the screwed displacing pile according to the penetrative resistance while the penetrative resistance is being found:

$$Rp = [2\pi Tb + Lb\{(1-c)S + cP + \alpha\pi Dw'\} - Qwh\pi Dw' - Qwvs] / \{(1-c)S + cP + \alpha\pi(Dp' + Dw')\}$$

α: coefficient of friction between ground and a steel plate,

Tb: torque acting on the pile end,

Lb: upper load acting on the pile end,

P: wing pitch,

S: quantity of penetration per one revolution,

Dp': diameter of an action circle of a bottom plate or a bottom plate portion,

Dw': diameter of an action circle of the wing,

Qwh: horizontal resistance of ground received by a blade end,

Qwv: vertical resistance of ground receive by the blade end, c: coefficient of consumed energy by ground caused by forced deformation of a wing directed upward, Rp: resistance of penetration of ground received by the bottom plate or the bottom plate portion.

5. A method of construction management for managing the construction of a screwed steel pile according to claim 4, wherein bearing capacity Qu of the pile end is estimated by the following equation:

$$Qu=(Rp/d)\times\{1+e(Aw/Ap)\}$$

where Aw is a projected area of the wing, Ap is a projected area of the bottom plate or the bottom plate portion, d is a coefficient of correction determined by a quantity of penetration at the time when the drilling of the pile is stopped, e ($0<e\leqq 1$) is an effective working ratio of the wing, and Qu is bearing capacity of the pile end.

6. A method of construction management for managing the construction of a screwed steel pile according to claim 4, wherein a pulling capacity Qup of the pile end with respect to pulling is estimated by the following expression:

$$Qup\geqq Rp-Lb$$

where Qup is pulling capacity of the pile end with respect to pulling.

7. A method of construction of a screwed steel pile comprising the steps of: using a screwed steel pile, the end portion of which is open, having a wing for drilling a ground, arranged outside in a lower portion of the pile, also using an auger having a spiral wing for drilling of an appropriate length, mounted on an auger shaft inserted into the pile, also using a pipe pile drive section for rotating the pile and also using an auger drive section for rotating the auger in the normal and the reverse direction; drilling, rotating and penetrating the pile into a soft stratum of the ground so as to drill soil and sand by the wing and forcibly discharge the drilled soil and sand to the periphery of the pile body, the rotation of the auger being stopped during penetrating the pile so that soil and sand cannot enter the pile; drilling and rotating the auger on a hard stratum of the ground such as an intermediate stratum and a bearing stratum of the ground so that the drilled soil and sand can enter the pile; and drawing out the auger from the pile after the completion of penetration of the pipe pile.

8. A method of construction management for managing the construction of a screwed steel pile having one or a plurality of wings on the lower end portion of the pile, comprising the steps of: finding penetrative resistance in the process of construction; and controlling to continue and/or complete penetration of the screwed steel pile according to the penetrative resistance while the penetrative resistance is being found;

wherein penetrative resistance Rp is found by the following equation:

$$Rp = \{(\cos\theta - \alpha\sin\theta)(Ht - Qwh) + (\sin\theta + \alpha\cos\theta)Lb\} / \{(1+\gamma)(\sin\theta + \alpha\cos\theta) + \alpha(Dp'/Dw')(\cos\theta - \alpha\sin\theta)\}$$

θ: angle of a wing with respect to a face perpendicular to a pile axis,

α: coefficient of friction between ground and a steel plate,

Ht: value obtained when torque acting on the pile end is converted into a horizontal force on an action circle, Lb: upper load acting on the pile end, Dp': diameter of an action circle of a bottom plate, Dw': diameter of an action circle of the wing, Qwh: horizontal resistance of ground received by a blade end, γ: coefficient of resistance of a perpendicular blade end, Rp: resistance of penetration of ground received by a bottom plate portion.

9. A method of construction management for managing the construction of a screwed steel pile according to claim 8, wherein bearing capacity Qu of the pile end is estimated by the following equation:

$$Qu=(Rp/d)\times\{1+e(Aw/Ap)\}$$

where Aw is a projected area of the wing, Ap is a projected area of the bottom plate portion, e ($0<e\leqq 1$) is an effective working ratio of a wing portion, d is a coefficient of correction determined by a quantity of penetration at the time when drilling of the pile is stopped, and Qu is bearing capacity of the pile end.

10. A method of construction management for managing the construction of a screwed steel pile according to claim 8, wherein a pulling capacity Qup of the pile end with respect to pulling is estimated by the following expression:

$$Qup\geqq Rp-Lb$$

where Qup is pulling capacity of tile pile end with respect to pulling.

* * * * *